US012276485B1

(12) United States Patent
Cheung et al.

(10) Patent No.: US 12,276,485 B1
(45) Date of Patent: Apr. 15, 2025

(54) DETECTING BODY SPIN ON A PROJECTILE

(71) Applicant: Northrop Grumman Systems Corporation, Falls Church, VA (US)

(72) Inventors: Philip Cheung, Burnsville, MN (US); Jared Wall, St. Anthony, MN (US); John Lamberg, Minnetonka, MN (US); Matthew P. Contons, Brooklyn Park, MN (US); Michael Balk, Shoreview, MN (US); Robert A. Sainati, Bloomington, MN (US); David Nohre, Monticello, MN (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 18/531,303

(22) Filed: Dec. 6, 2023

Related U.S. Application Data

(63) Continuation of application No. 18/106,828, filed on Feb. 7, 2023, now abandoned, which is a continuation (Continued)

(51) Int. Cl.
*F42B 10/14* (2006.01)

(52) U.S. Cl.
CPC ..... *F42B 10/14* (2013.01)

(58) Field of Classification Search
CPC ..... F42B 10/64; F42B 10/14; F42B 10/26; F42C 13/04; F42C 13/045

(Continued)

(56) References Cited

U.S. PATENT DOCUMENTS

404 A * 9/1837 Warner ..... F03B 3/00 415/186
2,340,781 A 2/1944 Wagner (Continued)

FOREIGN PATENT DOCUMENTS

CA 2441277 10/2002
EP 0675335 10/1995

(Continued)

OTHER PUBLICATIONS

Baig et al., "Architecture for Range, Doppler and Direction Finding Radar", J. Appl. Environ. Biol. Sci., vol. 4, No. 7S, 2014, pp. 193-198.

(Continued)

*Primary Examiner* — Michael D David
(74) *Attorney, Agent, or Firm* — Christensen, Fonder, Dardi and Herbert PLLC

(57) ABSTRACT

A body spin detection device for a projectile, the device including a perturbing element and a detection element electrically connected to detection circuitry in the projectile. The detection circuitry configured to receive, via the detection element, a first and second input signals and determine that the first input signal is different from the second input signal based on signal characteristics for the first and second input signals. The detection circuitry is further configured to determine a spin rate for at least one of the despun control portion and the chassis by determining a time period between receiving the first input signal and the second input signal.

20 Claims, 10 Drawing Sheets

Related U.S. Application Data of application No. 16/350,321, filed on Nov. 1, 2018, now Pat. No. 11,578,956.

(60) Provisional application No. 62/580,156, filed on Nov. 1, 2017.

(58) Field of Classification Search
USPC ..... 102/527, 501, 211, 214; 244/3.1
See application file for complete search history.

(56) References Cited

U.S. PATENT DOCUMENTS 2,513,157 A 6/1950 Ferris et al.
2,687,482 A * 8/1954 Harmon ..... F42C 11/04 102/214
2,996,008 A 8/1961 Allen et al.
3,000,307 A 9/1961 Trotter, Jr.
3,111,080 A * 11/1963 French ..... B30B 9/12 100/150
3,111,088 A 11/1963 Fisk
3,233,950 A 2/1966 Baermann
3,598,022 A 8/1971 Maier
3,614,181 A 10/1971 Meeks
3,747,529 A 7/1973 Plattner
3,913,870 A 10/1975 Bolick
3,939,773 A * 2/1976 Jenkins ..... F42B 10/04 102/526
3,943,520 A 3/1976 Apstein et al.
4,044,682 A 8/1977 Karayannis
4,088,076 A * 5/1978 Karayannis ..... F42C 11/04 102/209
4,176,814 A 12/1979 Albrektsson et al.
4,202,515 A * 5/1980 Maxwell, Jr. ..... G01S 3/781 244/3.11
4,207,841 A 6/1980 Bloomer
4,267,562 A 5/1981 Raimondi
4,347,996 A 9/1982 Grosso
4,373,688 A 2/1983 Topliffe
4,379,598 A 4/1983 Goldowsky
4,431,150 A 2/1984 Epperson, Jr.
4,438,893 A 3/1984 Sands et al.
4,512,537 A 4/1985 Sebestyen et al.
4,525,514 A 6/1985 Yachigo et al.
4,528,911 A * 7/1985 DePhillipo ..... F42B 12/38 102/513
4,537,371 A 8/1985 Lawhorn et al.
4,547,837 A * 10/1985 Bennett ..... F42B 6/06 420/586
4,565,340 A 1/1986 Bains
4,568,039 A 2/1986 Smith et al.
4,664,339 A 5/1987 Crossfield
4,665,332 A * 5/1987 Meir ..... H02K 21/125 416/169 R
4,667,899 A 5/1987 Wedertz
4,715,284 A * 12/1987 Hendry ..... F42B 5/24 102/434
4,815,682 A 3/1989 Feldmann et al.
4,860,969 A * 8/1989 Muller ..... F42B 10/14 244/3.28
4,898,342 A 2/1990 Kranz et al.
4,899,956 A * 2/1990 King ..... G05D 1/12 102/293
4,901,621 A * 2/1990 Tidman ..... F42B 6/006 89/8
4,934,273 A * 6/1990 Endriz ..... F42B 12/42 102/336
4,964,593 A 10/1990 Kranz
5,043,615 A 8/1991 Oshima
5,072,647 A * 12/1991 Goldstein ..... F42C 19/0811 102/440
5,101,728 A 4/1992 Frisk
5,125,344 A * 6/1992 Kline ..... F42B 10/06 102/703
5,126,610 A 6/1992 Fremerey
5,139,216 A 8/1992 Larkin
5,271,328 A * 12/1993 Boulais ..... F42C 11/04 102/207
5,321,329 A 6/1994 Hovorka
5,327,140 A 7/1994 Buckreub
5,381,445 A 1/1995 Hershey et al.
5,425,514 A 6/1995 Grosso
5,452,864 A * 9/1995 Alford ..... F42B 10/26 244/3.23
5,489,909 A 2/1996 Dittmann et al.
5,495,221 A 2/1996 Post
5,506,459 A 4/1996 Ritts
5,529,262 A 6/1996 Horwath
5,619,083 A 4/1997 Dunfield et al.
5,669,581 A 9/1997 Ringer
5,696,347 A * 12/1997 Sebeny, Jr. ..... G01S 13/44 102/214
5,725,179 A * 3/1998 Gilman ..... F42B 10/24 102/501
5,734,389 A * 3/1998 Bruce ..... F42C 13/042 342/68
5,747,907 A 5/1998 Miller
5,775,636 A 7/1998 Vig et al.
5,780,766 A * 7/1998 Schroppel ..... F42B 12/16 102/308
5,788,178 A 8/1998 Barrett, Jr.
5,894,181 A 4/1999 Imlach
5,917,442 A 6/1999 Manoogian
5,932,836 A 8/1999 White
5,971,875 A * 10/1999 Hill ..... F42B 10/26 473/578
5,982,319 A 11/1999 Borden et al.
5,986,373 A 11/1999 Stucker
6,020,854 A 2/2000 Jagnow et al.
6,052,647 A 4/2000 Parkinson et al.
6,126,109 A * 10/2000 Barson ..... F42B 10/14 244/3.28
6,135,387 A 10/2000 Seidel et al.
6,163,021 A 12/2000 Mickelson
6,186,443 B1 2/2001 Shaffer
6,204,801 B1 * 3/2001 Sharka ..... F42C 13/045 342/119
6,208,936 B1 3/2001 Minor et al.
6,227,820 B1 5/2001 Jarvik
6,234,082 B1 * 5/2001 Cros ..... F42B 14/02 102/520
6,314,886 B1 11/2001 Kuhnle et al.
6,345,785 B1 * 2/2002 Harkins ..... F42B 15/01 244/3.21
6,352,218 B1 3/2002 Holmqvist et al.
6,389,974 B1 * 5/2002 Foster ..... G01S 11/10 102/213
6,390,642 B1 * 5/2002 Simonton ..... F42B 12/362 362/276
6,398,155 B1 6/2002 Hepner et al.
6,422,507 B1 7/2002 Lipeles
D461,159 S 8/2002 Miralles et al.
6,493,651 B2 12/2002 Harkins et al.
6,502,786 B2 1/2003 Rupert et al.
6,588,700 B2 7/2003 Moore et al.
6,595,041 B2 7/2003 Hansen
6,629,669 B2 10/2003 Jensen
6,653,972 B1 11/2003 Krikorian et al.
6,666,402 B2 * 12/2003 Rupert ..... F42B 10/54 244/3.1
6,693,592 B2 * 2/2004 Dowdle ..... G01S 5/0273 342/453
6,727,843 B1 4/2004 Hansen
6,796,525 B2 * 9/2004 Johnsson ..... F42B 10/16 244/3.28
6,806,605 B1 10/2004 Gabrys
6,834,591 B2 * 12/2004 Rawcliffe ..... F42C 13/045 342/68
6,842,674 B2 1/2005 Solomon
6,869,044 B2 3/2005 Geswender
6,882,314 B2 4/2005 Zimmerman et al.
6,889,934 B1 5/2005 Thomas et al.

(56) References Cited

U.S. PATENT DOCUMENTS 6,923,404 B1 8/2005 Liu et al.
6,970,128 B1 11/2005 Dwelly et al.
6,981,672 B2 1/2006 Clancy et al.
7,015,855 B1 3/2006 Medl et al.
7,020,501 B1 * 3/2006 Elliott ..... H04W 52/0216 455/343.4
7,098,841 B2 * 8/2006 Hager ..... F42C 13/04 342/120
7,174,835 B1 * 2/2007 Knapp ..... F42B 12/382 102/458
7,226,016 B2 6/2007 Johnsson et al.
7,267,298 B2 9/2007 Leininger
7,296,520 B1 * 11/2007 McMullen, Jr. ..... H01Q 1/281 102/293
7,305,467 B2 12/2007 Kaiser et al.
7,338,009 B1 3/2008 Bobinchak et al.
7,341,221 B1 3/2008 Wilson
7,354,017 B2 4/2008 Morris et al.
7,412,930 B2 8/2008 Smith et al.
7,422,175 B1 9/2008 Bobinchak et al.
7,431,237 B1 10/2008 Mock et al.
7,475,846 B2 1/2009 Schroeder
7,500,636 B2 3/2009 Bredy
7,548,202 B1 * 6/2009 Jennings ..... H01Q 9/30 342/418
7,566,027 B1 7/2009 Johnson et al.
7,584,922 B2 9/2009 Bär et al.
7,626,544 B2 12/2009 Smith et al.
7,631,833 B1 12/2009 Ghaleb et al.
7,675,012 B1 3/2010 Bobinchak et al.
7,681,504 B2 * 3/2010 Machina ..... F42B 12/367 102/524
7,701,380 B2 4/2010 Altes
7,781,709 B1 * 8/2010 Jones ..... F42B 10/60 102/382
7,791,007 B2 9/2010 Harnoy
7,834,301 B2 11/2010 Clingman
7,849,797 B2 * 12/2010 Geswender ..... F42C 13/045 342/68
7,849,800 B2 12/2010 Hinsdale et al.
7,900,619 B1 * 3/2011 Palmer ..... F42B 12/42 124/16
7,947,936 B1 5/2011 Bobinchak et al.
7,963,442 B2 6/2011 Jenkins et al.
7,989,742 B2 8/2011 Bredy
7,999,212 B1 8/2011 Thiesen et al.
8,063,347 B1 11/2011 Urbano et al.
8,076,623 B2 12/2011 Dryer
8,113,118 B2 2/2012 Schmidt et al.
8,125,198 B2 2/2012 Steinbrecher
8,183,746 B2 * 5/2012 Rastegar ..... F42C 11/008 102/209
8,229,163 B2 7/2012 Coleman et al.
8,258,999 B2 * 9/2012 Rastegar ..... F42B 15/01 342/61
8,288,698 B2 10/2012 Seidensticker
8,288,699 B2 10/2012 Romero et al.
8,319,162 B2 11/2012 Mccool
8,319,163 B2 * 11/2012 Flood ..... F42B 10/26 102/501
8,319,164 B2 11/2012 Martinez
8,324,542 B2 * 12/2012 Frey, Jr. ..... F41G 7/305 244/3.13
8,344,303 B2 1/2013 Elgersma et al.
8,410,412 B2 4/2013 Geswender et al.
8,426,788 B2 4/2013 Geswender
8,471,186 B2 6/2013 Wallis
8,471,758 B2 6/2013 Samuel et al.
8,487,226 B2 7/2013 Biswell
8,508,404 B1 * 8/2013 Wilmhoff ..... F42C 13/045 342/357.56
8,519,313 B2 * 8/2013 Geswender ..... F42B 10/02 701/400
8,552,349 B1 10/2013 Alexander
8,552,351 B2 10/2013 Geswender et al.
8,558,151 B2 10/2013 Seidensticker
8,669,505 B2 3/2014 Guibout et al.
8,674,277 B2 * 3/2014 Axford ..... F42B 10/64 102/501
8,698,059 B2 4/2014 Nikkel et al.
8,701,558 B2 * 4/2014 Rastegar ..... F42C 14/06 102/207
8,716,639 B2 5/2014 Mallon
8,748,787 B2 6/2014 Weiss et al.
8,757,064 B2 * 6/2014 Jennings ..... G01S 17/04 102/213
8,812,654 B2 8/2014 Gelvin et al.
8,816,260 B2 8/2014 Hindman et al.
8,832,244 B2 9/2014 Gelvin et al.
8,836,503 B2 9/2014 Gelvin et al.
8,916,810 B2 12/2014 Geswender et al.
8,950,335 B2 * 2/2015 Stromberg ..... F42B 14/02 102/527
8,993,948 B2 3/2015 Geswender et al.
D729,896 S * 5/2015 Martinez ..... D22/115
9,031,725 B1 * 5/2015 DiEsposti ..... G01S 19/11 701/22
9,040,885 B2 5/2015 Morris et al.
9,048,701 B2 6/2015 Lang
9,052,202 B2 6/2015 Riley
9,070,236 B1 6/2015 DiEsposti
9,071,171 B2 * 6/2015 Rastegar ..... H02N 2/18
9,086,258 B1 7/2015 Vasudevan et al.
9,108,713 B2 8/2015 Tao et al.
9,187,184 B2 11/2015 Miralles et al.
9,194,675 B1 * 11/2015 Manole ..... F42B 8/20
9,211,947 B2 12/2015 Miralles
9,303,964 B2 * 4/2016 Wurzel ..... F42B 10/26
9,347,753 B1 * 5/2016 Horch ..... F42B 33/02
9,360,286 B2 6/2016 Pettersson et al.
9,371,856 B2 6/2016 Kundel
9,410,783 B1 * 8/2016 Khuc ..... F42C 15/40
9,557,405 B2 * 1/2017 Takahashi ..... G01S 5/16
9,587,923 B2 3/2017 Wurzel et al.
9,644,929 B1 5/2017 Bradbury et al.
9,683,814 B2 * 6/2017 Dryer ..... F41G 7/30
9,709,372 B2 * 7/2017 Edwards ..... F42C 13/04
9,939,238 B1 * 4/2018 Sowle ..... F42B 10/00
10,054,404 B2 * 8/2018 Balk ..... F41G 9/00
10,203,188 B1 2/2019 Sowle et al.
10,288,397 B2 5/2019 Rastegar et al.
11,031,885 B1 * 6/2021 Yavid ..... F42B 12/02
11,056,962 B2 7/2021 Kao
2001/0030260 A1 * 10/2001 Niemeyer ..... F42B 10/20 244/3.26
2003/0070571 A1 * 4/2003 Hodge ..... F42C 15/34 102/221
2003/0076260 A1 4/2003 Ryken et al.
2004/0046467 A1 3/2004 Huang et al.
2004/0068415 A1 * 4/2004 Solomon ..... G05D 1/0295 701/1
2004/0099173 A1 * 5/2004 Rector ..... F42B 12/382 102/501
2004/0134337 A1 * 7/2004 Solomon ..... G05D 1/0088 89/1.1
2005/0061191 A1 * 3/2005 Dietrich ..... F42C 17/04 102/215
2006/0061949 A1 * 3/2006 Chen ..... G06F 1/181 361/679.02
2008/0012751 A1 1/2008 Owens et al.
2008/0061188 A1 * 3/2008 Morris ..... F42B 10/54 244/3.1
2008/0093498 A1 * 4/2008 Leal ..... F41G 7/2206 244/3.22
2008/0115686 A1 * 5/2008 Crist ..... F42C 11/04 102/209
2008/0223977 A1 * 9/2008 Dryer ..... F42B 10/14 244/3.22
2008/0237391 A1 * 10/2008 Mock ..... F42B 10/64 244/3.1
2010/0199873 A1 * 8/2010 Rastegar ..... F42C 11/006 102/262

(56) References Cited

U.S. PATENT DOCUMENTS

| | | | | |
|---|---|---|---|---|
| 2010/0213307 | A1* | 8/2010 | Hinsdale | F42B 10/14 244/3.23 |
| 2010/0237185 | A1* | 9/2010 | Dryer | F42B 10/28 244/3.22 |
| 2011/0032361 | A1* | 2/2011 | Tamir | H04N 7/181 348/157 |
| 2011/0094372 | A1* | 4/2011 | Carlson | F42B 10/663 89/27.11 |
| 2012/0068000 | A1* | 3/2012 | Goldner | F42B 12/62 244/3.16 |
| 2012/0211593 | A1* | 8/2012 | Morris | F42B 10/54 244/3.21 |
| 2012/0255426 | A1* | 10/2012 | Reynard | F42C 17/04 89/6.5 |
| 2013/0126612 | A1* | 5/2013 | Durkee | F41G 7/346 244/3.23 |
| 2013/0126667 | A1* | 5/2013 | Weiss | F41G 7/24 244/3.15 |
| 2013/0126668 | A1* | 5/2013 | Chessel | B64B 1/40 244/31 |
| 2014/0158814 | A1* | 6/2014 | Elkayam | F42B 15/01 86/51 |
| 2015/0203201 | A1 | 7/2015 | Tao et al. | |
| 2015/0330755 | A1 | 11/2015 | Citro et al. | |
| 2016/0185445 | A1 | 6/2016 | Miralles et al. | |
| 2016/0252333 | A1* | 9/2016 | Carlqvist | F42B 10/50 244/3.26 |
| 2016/0347476 | A1 | 12/2016 | Andryukov | |
| 2017/0021945 | A1 | 1/2017 | Fisher et al. | |
| 2017/0023057 | A1 | 1/2017 | Li et al. | |
| 2017/0191809 | A1* | 7/2017 | Harris | F42B 30/10 |
| 2017/0299355 | A1* | 10/2017 | Trouillot | F42B 10/14 |
| 2018/0245895 | A1* | 8/2018 | Malul | F42B 10/14 |
| 2019/0041175 | A1* | 2/2019 | Fellows | F42B 14/061 |
| 2019/0041527 | A1* | 2/2019 | Gustafson | G01S 19/215 |
| 2019/0107374 | A1* | 4/2019 | Hill | F42B 10/62 |
| 2019/0302276 | A1 | 10/2019 | Sandford | |
| 2020/0064112 | A1* | 2/2020 | Rami | F41G 3/04 |
| 2020/0292287 | A1 | 9/2020 | Thoren et al. | |

FOREIGN PATENT DOCUMENTS

| | | |
|---|---|---|
| EP | 2165152 | 8/2014 |
| GB | 2547425 | 8/2017 |
| WO | WO2007058573 | 5/2007 |

OTHER PUBLICATIONS

Bekmezci et al., "Flying Ad-Hoc Networks (FANETs): A Survey", posted on the Internet at elsevier.com/locate.adhoc; Jan. 8, 2013, published by Elsevier, Amsterdam, The Netherlands; 17 pages.

Costanzo et al., "High Resolution Software Defined Radar System for Target Detection", Journal of Electrical and Computer Engineering, vol. 2013, Article ID 573217, 2013, 8 pages.

Deng, Zilong et al., "Roll Angle Measurement for a Spinning Vehicle Based on GPS Signals Received by a Single-Patch Antenna", Sensors, 18 (10), 3479, Oct. 16, 2018, pp. 1-22.

Kwag et al., "Modern Software Defined Radar (SDR) Technology and Its Trends", Journal of Electromagnetic Engineering and Science, vol. 14, No. 4, Dec. 2014, pp. 321-328.

Zhang, B. et al. Mechanical Construction and Analysis of an Axial Flux Segmented Armature Torus Machine, International Conference on Electrical Machines, Sep. 2-5, 2014, pp. 1293-1299.

Zou, T. et al., "Analysis of a Dual-Rotor, Toroidal-Winding, Axial-Flux Vernier Permanent Magnet Machine", Institute of Electrical and Electronics Engineers, May/Jun. 2017, vol. 53, No. 3, pp. 1920-1930.

* cited by examiner

DETECTING BODY SPIN ON A PROJECTILE

CROSS REFERENCE TO RELATED APPLICATIONS

The present application is a continuation of U.S. patent application Ser. No. 18/106,828, filed Feb. 7, 2023, which is a continuation of U.S. patent application Ser. No. 16/350,321, filed Nov. 1, 2018, issued as U.S. Pat. No. 11,578,956 on Feb. 14, 2023, which claims the benefit of U.S. Provisional Application No. 62/580,156, filed Nov. 1, 2017, the entire contents of which are incorporated by reference herein.

TECHNICAL FIELD

The present disclosure relates to spin stabilized projectiles, and more specifically, to spin stabilized projectiles having a despun control portion.

BACKGROUND

In various instances, non-boosted barrel-fired projectiles, such as bullets, shells, or other projectiles, are spin-stabilized to improve their accuracy via improved in-flight projectile stability. Generally, these projectiles are fired from a rifled barrel where rifled grooves grip the projectile and force it to spin at a high rate about a central projectile axis as it is pushed down the bore of the barrel by propellant gasses. This process imparts a spin to the projectile as it passes through the bore and, as such, the projectile is stabilized for flight.

Spin stabilized guided projectiles fired from rifled barrels typically have a main body portion and a flight control portion rotatable with respect to the main body. The rifling in the barrel rotates the projectile in a first direction by way of engagement with the main body portion or sabots containing the projectile. Upon firing, the main body portion is spun in a first rotational direction at a spin rate based on rifling and muzzle velocity. In some cases, the spin rate may exceed 10 kHz. The flight control portion of the projectile has aerodynamic surfaces, such as fins, to despin the flight control portion using oncoming airflow after the projectile is fired. The differential in spinning between the flight control portion and the main body portion may provide power for operating systems in the projectile. In some instances, the spin rate of the flight control portion may be generally slowed or braked to 0 Hz, with respect to earth, by a braking system, and have an aerodynamic surface that may be appropriately positioned, that is, positioned in a desired rotational area, for changing the direction of the projectile.

Further improvements are always welcome for enhancing accuracy, allowing miniaturization, increasing range, providing cost savings and improved reliability of guided ammunition.

SUMMARY

Embodiments of the present disclosure are directed to method, system, and device for projectile body spin detection. In one or more embodiments the projectile includes a nose portion with a forward tip, a body portion, a tail portion, and a central axis. In various embodiment the projectile includes a chassis extending from the tail portion to the nose portion and further defining a collar support portion including a despun collar portion rotationally mounted therein. In various embodiments the despun collar portion is separated axially from the chassis for free despinning of the despun collar portion relative to the chassis and for directional collar of the projectile. In one or more embodiments the despun collar portion is separated axially by a gap between a first face of the despun collar portion and an opposing annular shoulder of the chassis.

As used herein, the terms "despun", "despin", "despinning", or other variant of the term, refers to an object that is spun in a direction about its longitudinal axis that, in some instances, is counter-rotational with another portion of the projectile. However, the terms also include objects that are the only spun or spinning portion of the projectile. For example, in some instances a despun collar refers to a collar that is spinning about its longitudinal axis while a remainder of the projectile has a 0 Hz rotational motion, relative to the earth. As such, the terms "despun" and "spun" or variant of either of these terms are used interchangeably herein.

In one or more embodiments the projectile includes a body-spin detection system. In various embodiments the detection of spin is used to determine the spin rate of one or more portions of the projectile. In addition, in certain embodiments, the body-spin detection system is sued to determine the instances at which one or more portions of the projectile are rotationally oriented in certain positions. For example, in various embodiments the body-spin detection system is configured to detect the rotational orientation of despun collar portion and/or other portion of the projectile about the longitudinal central axis of the projectile during projectile flight.

In addition, one or more embodiments provide a mechanism for body-spin detection compatible for use with a wide variety of projectiles. Installation in various types of legacy designs, or in some instances, retrofitting existing ammunition with embodiments of the present disclosure.

For example, one or more embodiments provide a body-spin detection mechanism that minimizes projectile drag associated with components of the mechanism. As such various embodiments provide a detection system that does not disrupt or otherwise alter projectile trajectory during flight and is compatible with projectiles designed for high velocity ballistic trajectories. In addition, various embodiments provide a body-spin detection mechanism that does not require significant volume inside the body of the projectile. As a result, in various embodiments the mechanism is compatible with various projectile calibers, including medium or small caliber projectiles. In addition, because one or more embodiments provide a body-spin detection mechanism that does not require significant volume inside the body of the projectile, various embodiments are further compatible with projectiles including internal payload or other components requiring internal volume within the projectile.

In addition, various embodiments utilize detection and perturbation elements that can be embedded within surface cavities of the projectile. In various embodiments this provides a minimum of disruption of the projectile aerodynamics. While also allowing the detection and perturbation element to be protected from mechanical damage. For example these elements could be protected by suitable coatings or simply due to a recessed placement within the projectile. In various embodiments the detection electronics are relatively simple and can include wave guiding structures, making the body spin detection system relatively immune to external electromagnetic interference.

As such, in one or more embodiments the body spin detection device includes a detection element mounted in one of the first face of the despun collar portion and the annular shoulder of the chassis, and a perturbing element mounted in the other of the first face and the annular shoulder. In various embodiments the perturbing element and the detection element positioned opposing one another such that the despun collar portion has a first rotational orientation about the central axis where the perturbing element and the detection element are rotationally aligned and a second rotational orientation where the perturbing element and the detection element are rotationally non-aligned.

In various embodiments the body spin detection device includes detection circuitry electrically coupled with the detection element, the detection circuitry including a processor and a computer readable storage medium, the computer readable storage medium including a set of instructions executable by the processor. In various embodiments the set of instructions cause the detection circuitry to receive, via the detection element, a first input signal and determine a first set of signal characteristics for the first input signal and receive, via the detection element, a second input signal and determine a second set of signal characteristics for the second input signal. In certain embodiments the set of instructions further cause the detection circuitry to determine, by comparing the first set of signal characteristics to the second set of signal characteristics, that the first input signal is different from the second input signal and determine a spin rate for at least one of the despun collar portion and the chassis by determining a time period between receiving the first input signal and the second input signal.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
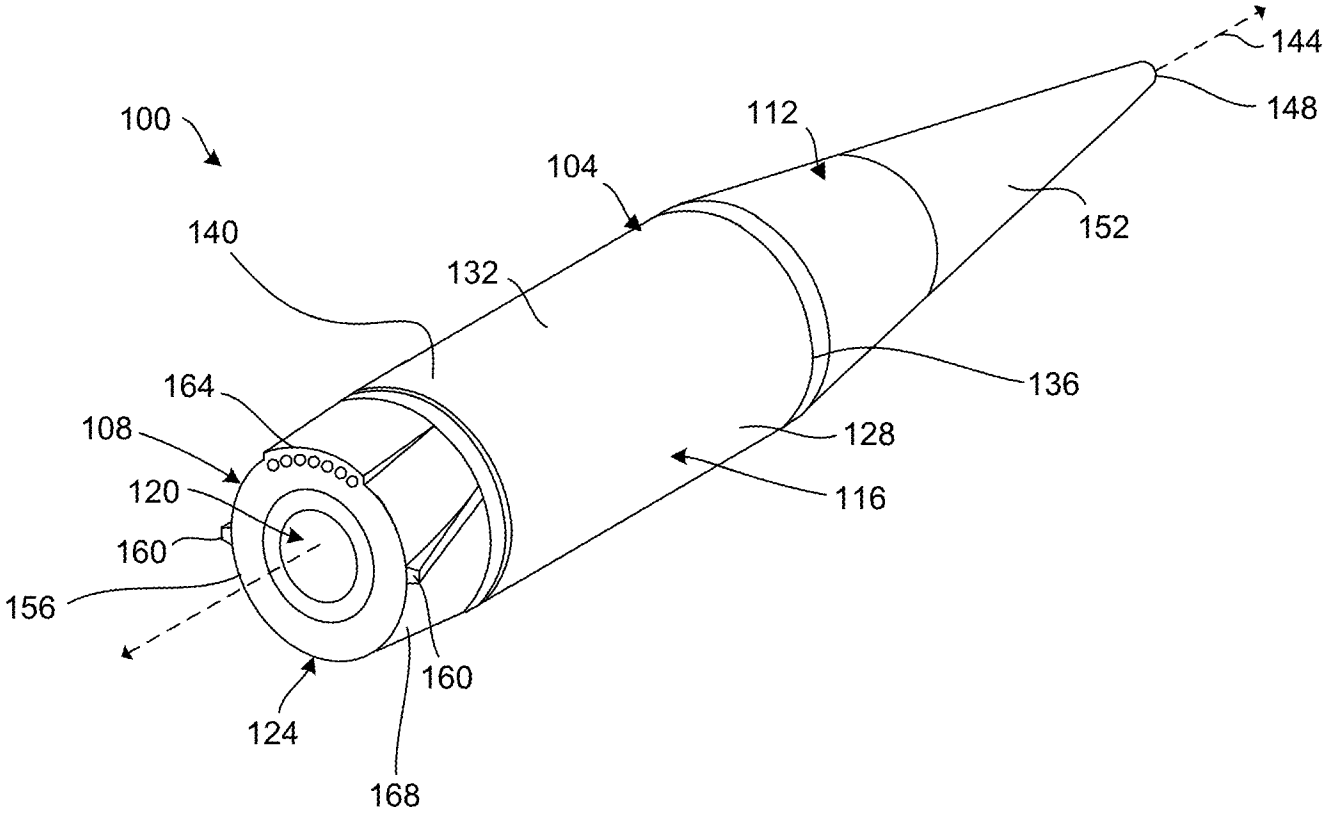
FIG. 1 depicts a rear perspective view of a spin-stabilized guided projectile according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

FIG. 1 depicts a rear perspective view of a spin-stabilized guided projectile 100 according to one or more embodiments of the disclosure. In various embodiments, the projectile is non-boosted or non-propelled and is fired from a gun. As used herein, the terms "non-boosted", or "non-propelled", means that no active propulsion means such as powered propellers, turbines, jet engines, rocket engines, or propellants are associated with the projectile after it leaves the muzzle of the gun. Rather, a non-boosted or non-propelled projectile includes projectiles that are fired using propellant included in a casing of a cartridge of which the projectile is part. However, in other embodiments the projectile 100 could be boosted or self-propelled, where the projectile 100 includes active propulsion means such as powered propellers, turbines, jet engines, rocket engines, or propellants are associated with the projectile after it leaves the muzzle of the gun.

As used herein, the term "spin-stabilized" means that the projectile is stabilized by being spun around its longitudinal (forward to rearward) central axis. The spinning mass creates gyroscopic forces that keep the projectile resistant to destabilizing torque in-flight. In addition, projectile stability can be quantified by a unitless gyroscopic stability factor (SG). As used herein, the term "spin-stabilized" additionally refers to projectiles that have a spin rate that is high enough to at least achieve a SG of 1.0 or higher. Additional discussion of gyroscopic stability factor can be found, for example, in U.S. application Ser. No. 15/998,144, titled "Active Spin Control" incorporated by reference herein in its entirety.

In one or more embodiments, the projectile 100 includes a main body portion 104, a tail portion 108, and a nose portion 112. A chassis 116 extends from the nose portion 112, defines the main body portion 104, and extends to the tail portion 108. The chassis 116 is, in some embodiments, machined or formed from a single block of metal. In some embodiments, the chassis 116 includes a control support portion 120 for supporting a despun control portion 124, which is discussed further below.

In one or more embodiments, the main body portion 104 provides a structure for containing and/or supporting various elements of the projectile 100 including payload and operational components. In certain embodiments, the main body portion 104 has a cylindrical shape or a generally cylindrical shape defined by a main body sidewall 128. In some embodiments, the main body sidewall 128 may be part of the chassis 116 as illustrated, or there may be an additional wall or surface exterior of the chassis 116. In various embodiments the main body portion 104 has an exterior surface 132, a forward portion 136 and a rearward portion 140.

In some embodiments, the main body sidewall 128 includes one or more tapered portions that converge in a direction along a central axis 144. For example, in some embodiments a first portion, such as the forward portion 136 including some or all of the main body sidewall 128 converges in a forward direction, along central axis 144, towards the nose portion 112. In some embodiments, a second portion, such as the rearward portion 140 including some or all of the main body sidewall 128, could converge in a rearward direction towards the tail portion 108.

In one or more embodiments the chassis 116 defines, at the tail portion 108, the control support portion 120. In various embodiments, the control support portion 120 is a structure that is unitary or integral with the chassis 116 for supporting various components of the projectile 100. In one or more embodiments, the control support portion 120 includes an axially projecting central stub portion for supporting the despun control portion 124 and other elements of the projectile 100. For example, in various embodiments, the central stub portion supports components for internal power generation, braking components, or other components of the projectile 100. In certain embodiments, communication componentry, sensing components, processing components, or other components of the projectile 100 may be located within the control support portion 120, for example, within a cavity formed within the central stub portion.

While various embodiments of the disclosure refer to a control support portion 120, it is intended that the term can alternatively/interchangeably be referred to as a collar support portion. For example, where the despun control portion is referred to as a despun collar portion, described further below.

The nose portion 112 is a forward facing (e.g. in the first direction) structure and has a tapered or a converging shape. The nose portion 112 extends from the forward portion 136 of the main body portion 104, forwardly, in a first direction, along central axis 144 to a forward tip portion 148. In various embodiments, nose portion 112 has an exterior surface 152 and may be conical or have a curved taper from the forward portion 136 of the main body portion 104 to the forward tip portion 148.

In various embodiments, projectile 100 is a medium or high caliber spin-stabilized projectile for firing from a rifled barrel or gun. For example, in certain embodiments, projectile 100 is a 57 mm (millimeter) medium caliber round. In some embodiments, projectile 100 is a 90 mm large caliber round. In certain embodiments, projectile 100 is a small caliber round. As used herein, a medium caliber projectile includes rounds greater than 50 caliber up to about 75 mm, a large caliber projectile includes rounds greater than 75 mm, and small caliber projectiles include rounds less than 50 caliber.

In some embodiments, the main body portion 104 can include a plurality of lift strakes. In one or more embodiments, lift strakes are aerodynamic ridges or fins extending from the main body portion 104 or other portion of the spin-stabilized projectile 100.

In some embodiments, the main body portion 104 of the projectile 100 includes a crimped portion and a band for coupling with a casing of a cartridge. The crimped portion may include various indentations in the chassis 116 that allow for a secure connection between the chassis 116 and the casing of a cartridge. In certain embodiments, the band is constructed of material such as nylon, plastic, copper, or other suitable material and allows for a secure sealing engagement with a rifled barrel of a gun for firing.

In one or more embodiments, portions of the despun control portion 124 are rotatably mounted to the control support portion 120 and are independently rotatable for despinning with respect to the chassis 116, the main body portion 104, the nose portion 112, and the control support portion 120. In one or more embodiments, the components of the despun control portion 124 include a flight control portion, configured as a collar 156.

In one or more embodiments, the collar 156 of the despun control portion 124 includes a plurality of aerodynamic control surfaces and structures disposed on an external wall. For example, as seen in FIG. 1, collar 156 includes fins or strakes 160 and flap 164. In various embodiments strakes 160 wrap around and extend axially from an exterior surface 168 of the collar 156 in a spiral arrangement configured to despin the despun control portion 124 when the projectile is traveling through the air. In one or more embodiments flap 164 is a section of sidewall raised with respect to the exterior surface 168.

In one or more embodiments, the despun control portion 124 includes various components of the spin-stabilized projectile 100. For example, the despun control portion 124 may include components for generating power or electricity in the spin-stabilized projectiles 100. In some embodiments the despun control portion 124 includes power-generation components such as a ring cluster of magnets aligned with a corresponding ring of armature coils, a hydraulic pump electricity generating means, or other power generating components. In some embodiments, the despun control portion 124 includes a battery or other power storage components.

While various embodiments of the disclosure refer to a despun control portion 124, it is intended that the term can alternatively/interchangeably be referred to as a despun collar portion.

In operation, the projectile 100 can be loaded into a projectile delivery system, such as a gun with a rifled barrel, and fired. The projectile 100 may be fired at various muzzle velocities and at various muzzle spin rates based on the propellant used and the design (e.g. rifling) of the projectile delivery system. For example, in one or more embodiments, the projectile 100 is fired having an initial spin rate of 1300 Hz±100 Hz. In various embodiments, when fired, the initial spin rate of the projectile 100 is substantially within the range of 800 Hz-2000 Hz.

In various embodiments, when fired, the interaction of the aerodynamic control surfaces with oncoming wind or air cause the despun control portion 124 to despin relative to the main body portion 104, the nose portion 112, and the control support portion 120. In various embodiments the spin rate of the despun control portion 124 causes a relative rotation of the power-generation components for powering the components of the projectile 100.

In one or more embodiments, when fired, the spin rate of the despun control portion 124 is about 1300 Hz±100 Hz. In some embodiments, when fired, the spin rate of the despun control portion 124 is substantially within the range of 800 Hz-2000 Hz.

In operation, the despun control portion 124 is configured for resistive breaking, using power-generation components to control the spin rate of the despun control portion 124 and/or the spin rate of the remainder of the projectile 100. For example, in some embodiments resistive breaking may be used to control the spin rate of the despun control portion 124 to approximately Hz relative to the earth. In some embodiments, the resistive braking could be used to completely brake the despin of the despun control portion 124 with respect to the chassis 116. In certain embodiments, resistive braking may be used to slow but not stop the despin of the despun control portion 124 with respect to the chassis 116. For example, resistive braking could be configured to brake the spin rate of the collar to some percentage of the spin rate of a fully unbraked collar.

Spin rate control of a projectile using a despun control portion is discussed further in U.S. Provisional application Ser. No. 15/998,114, titled "Active Spin Control", incorporated by reference above.

By controlling the spin rate, the despun control portion 124 may be used to provide a moment or maneuvering force on the projectile 100 for altering trajectory, speed, or other flight characteristics of the spin-stabilized projectile 100. For example, in one or more embodiments, by controlling the spin rate the despun control portion 124 may be used to control the orientation of the flap 164 or other aerodynamic control surfaces to act as a foil for aerodynamically providing a moment on the projectile 100. As such, the orientation of the projectile 100 can be torqued by the moment or maneuvering force to control the in-flight trajectory of the projectile 100.

As a consequence of the ability to control the in-flight trajectory of the projectile 100, in various embodiments, the despun control portion 124 extends the effective range of the projectile 100 by using the despun control portion 124 to compensate for various environmental/in-flight factors that influence the projectile off its originally aimed path and to otherwise steer the projectile to its target.

FIG. 1 and other figured described below depict a projectile 100 having a rearwardly positioned despun control portion 124 in the form of a collar assembly including collar 156 and other various components. However, in various embodiments the projectile 100 can instead include a despun control portion positioned in main body portion 104, nose portion 112, or in other portion of the projectile 100, where the despun control portion is configured for despinning relative to the chassis 116 and for directional control of the projectile 100. In addition, while the despun control portion may, in some embodiments, be designed as a collar, in certain embodiments the despun control portion may utilize other types of designs suitable for directional projectile control. Further, in certain embodiments, the despun control portion may include fixed or non-fixed aerodynamic features such as deployable or actuatable fins, canards, and strakes.

Figure 2:
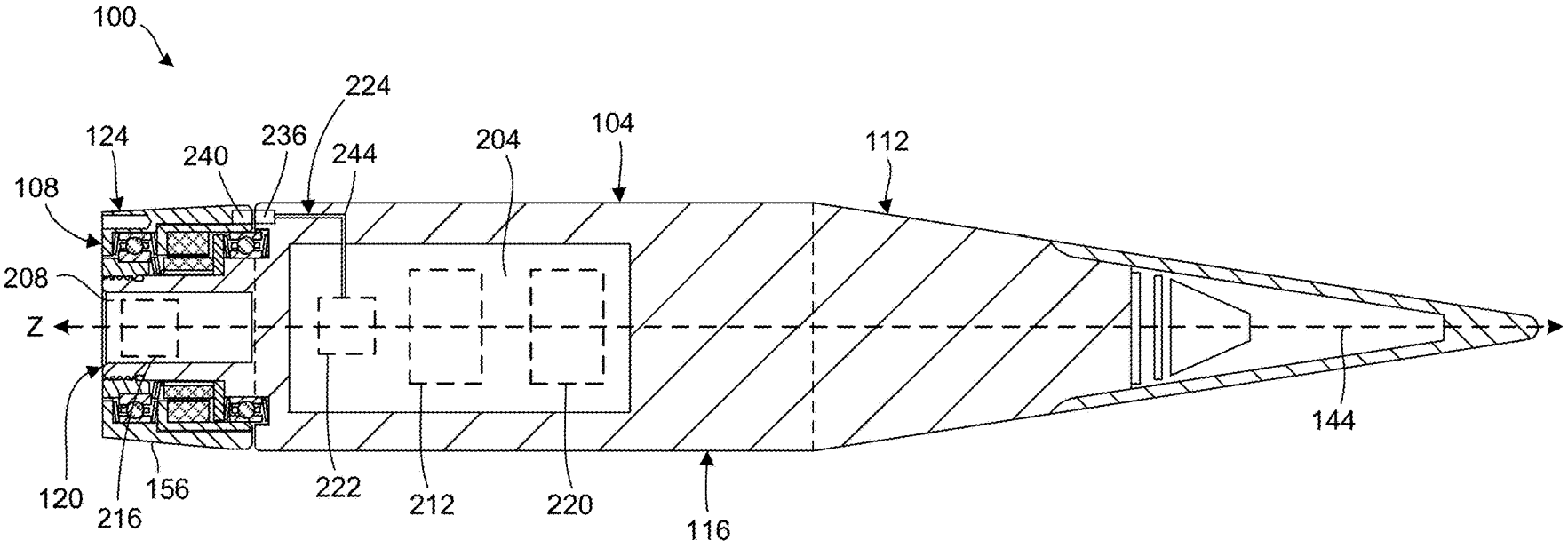
FIGS. 2-3 depict cross-sectional views of the despun control portion 124 and projectile 100 are depicted, according to one or more embodiments of the disclosure.
Figure 3:
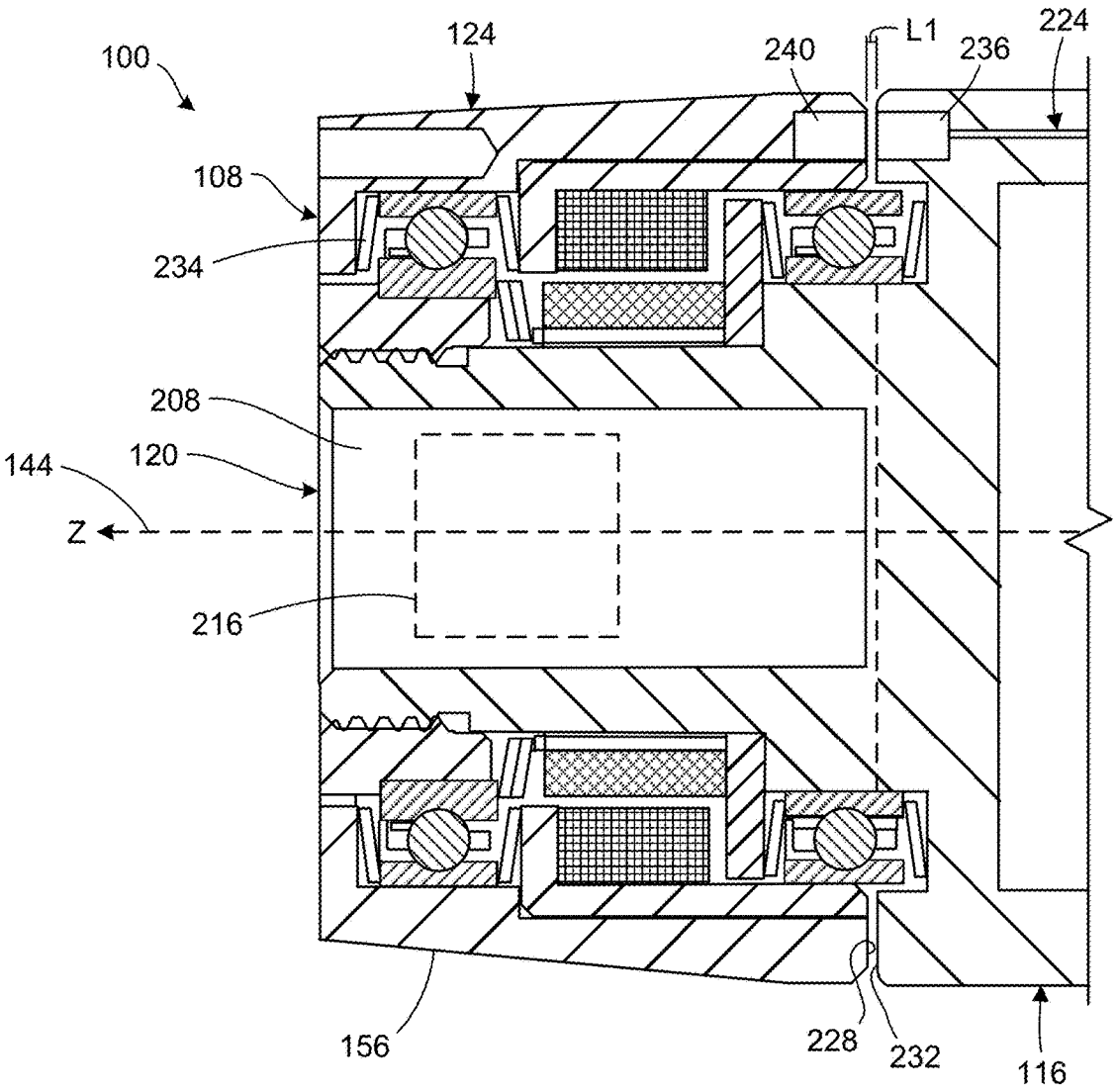

Referring to FIGS. 2-3, cross-sectional views of the despun control portion 124 and projectile 100 are depicted, according to one or more embodiments of the disclosure. In one or more embodiments the despun control portion 124 is mounted on and around the control support portion 120. As described above, in various embodiments portions of the despun control portion 124 are independently rotatable for despinning with respect to the chassis 116, the main body portion 104, the nose portion 112, and the control support portion 120.

As described above, in various embodiments the main body portion 104 and the control support portion 120 can be a chassis for supporting various components of the projectile 100. For example, in some embodiments, main body portion 104 includes cavity 204 and control support portion 120 includes cavity 208 for containing various componentry circuitry, or other elements of the projectile 100. For example, in one or more embodiments, cavities 204, 208, can include various computer circuitry, such as a processor, computer readable storage medium, sensors, or other components or circuitry. For example, cavities 204, 208, may include a processor portion 212, a transceiver portion 216 which may include one or more transceivers for communication with other projectiles or a firing platform, a sensor portion 220 such as for tracking targets and receiving signals, and body spin detection circuitry 222 as part of a body spin detection device 224 for determining the body spin rate of the projectile 100, described further below. In some embodiments, the cavity 208 includes components of an alternator or other device that cooperates with power-generation components to generate power in the projectile 100.

The processor portion 212 may include various computer circuitry for a processor, a computer readable storage medium, and other circuitry. As used herein, the computer readable storage medium is a tangible device that retains and stores instructions for use by an instruction execution device (e.g. a processor, or other logic device). In some embodiments, the computer readable storage medium includes, but is not limited to, a hard disk, a random access memory (RAM), a read-only memory (ROM), an erasable programmable read-only memory (EPROM or Flash memory), a static random access memory (SRAM), and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

In some embodiments, the computer readable storage medium has program instructions embodied therein. In one or more embodiments the program instructions are executable by the processor portion 212 to cause the processor to perform various functions for control of the projectile 100. For example, and described further below, the instructions may cause the processor to determine a spin rate for spin stabilized projectile 100 according to various embodiments of the disclosure.

In some embodiments, cavity 204 is communicatively connected with cavity 208. For example, cavity 204 and 208 may each include various computer circuitry which may be communicatively connected using a bus, one or more wires, or other suitable connection. As such, in various embodiments processor portion 212, transceiver portion 216, sensor portion 220, spin detection circuitry 222, and other elements can be communicatively connected to one another regardless of their placement in one or more of the various internal cavities 204, 208 of the projectile 100.

Referring to FIG. 3, the despun control portion 124 includes a first face 228 positioned adjacent to a rearwardly facing annular shoulder 232 of the chassis 116. Depicted in the figures, the despun control portion 124 and main body portion 104 are separated by a gap having a length L1. In various embodiments length L1 separates the despun control portion 124 from the chassis 116 such that during projectile flight the despun control portion 124 can rotate about the control support portion 120 while minimizing friction from other elements of the projectile. In addition, in one or more embodiments, the length L1 of the gap between the despun control portion 124 and main body portion 104 is such that the despun control portion 124, using support springs 234, is flexibly compliant along axis 31 for improved survivability during firing. In some embodiments, the length L1 is approximately one millimeter (mm). However, described further below, the length L1 can vary and could be larger than or smaller than 1 mm in certain embodiments.

Referring again to FIGS. 2-3, in one or more embodiments the projectile 100 includes the body spin detection device 224. In various embodiments the body spin detection device 224 includes a detection circuit 222, detection element 236, and a perturbing element 240. In one or more embodiments, the body spin detection device 224 and the perturbing element 240 are mounted in the chassis 116 and in the despun control portion 124 of the projectile 100, respectively. In various embodiments the detection element 236 and the perturbing element 240 are mounted on or exposed via the outside surface of the projectile 100. For example, depicted in FIGS. 2-3 the detection element 236 is mounted in the surface of the rearwardly facing annular shoulder 232 of the chassis 116 and the perturbing element 240 is mounted to the first face 228 of the despun control portion 124. In certain embodiments the detection element 236 and the perturbing element 240 are flush mounted to the outside surface of the projectile 100. In such embodiments, the body spin detection device 224 is mounted such that no portion of the body spin detection device 224 extends outwardly from the outer surface of the projectile and no portion of the body spin detection device changes the aerodynamic characteristics of the projectile 100.

Further, while FIGS. 2-3 depict the perturbing element 240 mounted in the despun control portion 124 and the detection element 236 mounted in the chassis 116, in various embodiments these positions could be reversed, or could include other positions on the projectile 100.

In various embodiments the detection circuit 222 is electrically connected to the detection element 236 and may be located inside the same portion of the projectile 100 as the detection element 236. For example, depicted in FIGS. 2-3, the detection circuit 222 is positioned in the recess 204 of the main body portion 104 and electrically connected to detection element 236 via electrical connection 244. In various embodiments the electrical connection 244 is a coaxial cable, or other suitable wire or connection device.

As described above, during projectile flight, as a result of the aerodynamic forces on the despun control portion 124, the despun control portion 124 rotates about the control support portion 120 causing a relative rotation of the despun control portion 124 relative to the chassis 116 and about the central axis 144. As a result of the relative rotation of the despun control portion 124 to the chassis 116, the perturbing element 240 in the despun control portion 124 also rotates with respect to the detection element 236 about central axis 144.

As such, in various embodiments, during projectile flight, the detection element 236 and perturbing element 240 will alternate between two states including a first state where the elements 236, 240 are rotationally aligned and a second state where the elements 236, 240 are not rotationally aligned. For example, depicted in FIGS. 2-3, the detection element 236 and the perturbing element 240 are axially aligned and configured in the first state. In various embodiments the first state includes situations where the detection element 236 and the perturbing element 240 are only partially aligned. For example, in certain embodiments the first state includes rotational orientations of the detection element 236 and the perturbing element 240 where any portion of the detection element 236 and the perturbing element 240 overlap. In certain embodiments, in the second state, the detection element 236 and the perturbing element 240 are not aligned such that the detection element 236 is positioned directly across from a portion of the first face 228 of the despun control portion 124 that does not include the perturbing element 240.

In one or more embodiments, the detection circuit 222, detection element 236, and perturbing element 240 are configured together as an amplitude signal detector or a phase signal detector. As such, in one or more embodiments, in operation, the detection circuit 222 generates an electrical signal in the form of an electromagnetic wave that is transmitted, via electrical connection 244, to the detection element 236. In various embodiments the electrical connection 244 and detection element 236 carry this signal to a portion of the detection element 236 that is located at the outside surface of the annular shoulder 232. In operation, in one or more embodiments, the electrical signal is transmitted outward of the detection element 236, which acts as a waveguide directing the electrical signal from the annular shoulder 232 towards the first face 228 of the despun control portion 124 and perturbing element 240.

As such, in various embodiments, if the perturbing element 240 and detection element 236 are configured in the first state, the perturbing element 240 will receive the electrical signal directed from the detection element 236. However, if the perturbing element 240 and the detection element 236 are configured in the second state, the electrical signal will be directed to a portion of the first face 228 not including the perturbing element 240.

In certain embodiments a portion of the electrical signal may be reflected by the first face 228 of the despun control portion 124 and will reflect back to the detection element 236, through electrical connection 244 and into the detection circuitry 222. In certain embodiments, the perturbing element 240 will also reflect a portion of the electrical signal back to the detection element 236.

In various embodiments, the electronics in the detection circuitry 222 are configured to detect and measure characteristics of this reflected signal. For example, in various embodiments, the detection circuit 222 is configured to detect the amplitude, phase, or other properties of an electromagnetic wave.

In one or more embodiments, the characteristics (e.g. amplitude, phase, etc.) of the reflected electrical signal will differ based on whether the signal is reflected by the first face 228 or is reflected by the perturbing element 240. For example, described further below, in various embodiments the perturbing element 240 includes various features that modify or alter the characteristics of the reflected electric signal as compared to when the signal is reflected by the first face 228. As such, in various embodiments, the reflected electrical signal can act as a reference signal for the detection circuitry 222 where the reference signal possesses a first set of signal characteristics or a second set of signal characteristics that are based on whether the signal was reflected off of the perturbing element 240 or the first face 228, respectively.

As such, in various embodiments the detection circuit 222 is configured to determine the state of rotational orientation of the detection element 236 and the perturbing element 240. For example, if the detection circuit 222 determines that the reference signal has the first set of signal characteristics the detection circuit 236 can determine that the detection element 236 and the perturbing element 240 are configured in the first state (e.g. rotationally aligned). Similarly, if the detection circuit 222 determines that the reference signal has the second set of signal characteristics the detection circuit 222 can determine that the detection element 236 and the perturbing element 240 are configured in the second state (e.g. non-aligned).

As such, in various embodiments the signal characteristics of the reference signal can be used to detect the times at which the perturbing element 240 is aligned with the detection element 236. As such, in various embodiments this information can be used to determine spin rate and/or the rotational orientation of the despun control portion 124 about the central axis 144. For example, because of the aerodynamic despin of the despun control portion 124 during flight, in various embodiments the instances where the detecting circuit 222 detects that the perturbing element 240 is aligned with the detection element 236 will indicate a full rotation of the despun control portion 124 about central axis 144. In certain embodiments, the period of time between each instance of the detecting circuitry 222 detecting that the perturbing element 240 and detection element 236 are aligned can be used to determine the rate or speed of rotation of the despun control portion 124 relative to the chassis 116.

In some embodiments, the perturbing element 240 includes various features such that the perturbing element 240 is configured to substantially absorb the transmitted electrical signal from the detection element 236. In such embodiments, the perturbing element 240 does not cause a reflected signal. In such embodiments, the reflected electrical signal from the first face 228 is used as a reference signal for the detecting circuitry 222, and the lack of a reflected signal indicates that the perturbing element 240 and the detection element 236 are aligned in the first state.

In various embodiments the difference between the instances when the detection circuit 222 detects the reflected signal compared with the instances when the detection circuit fails to detect the reflected signal is used to detect the times at which the perturbing element 240 is aligned with the detection element 236 or not. Similarly, as described above, this information can be used to determine spin rate and/or the rotational orientation of the despun control portion 124 about the central axis 144.

While various embodiments herein describe that the detection element 236 is configured to transmit the electrical signal, in some embodiments the perturbing element 240 can be configured to generate a reference signal for detection by the detecting circuit 222. In such embodiments, the perturbing element 240 is configured as a waveguide such that an electronic reference signal is transmitted outward of the perturbing element 240 from the first face 228 to the annular shoulder 232 of the chassis 116.

As such, in various embodiments, if the perturbing element 240 and detection element 236 are rotationally aligned, configured in the first state, the detection element 236 will receive the electrical signal directed from the perturbing element 240. However, if the perturbing element 240 and the detection element 236 are non-aligned, configured in the second state, the reference signal will instead reflect off the annular shoulder 232 and will not be received by the detection element 236 for detection by the detection circuitry 222.

In such an embodiment, where the perturbing element 240 is configured to generate the reference signal, the presence of the reflected electrical signal will indicate that the perturbing element 240 and the detection element 236 are configured in the first state while the lack of a detected reference signal will indicate that the perturbing element 240 and the detection element 236 are configured in the second state.

As described above, in various embodiments, the time difference between the instances when the detection circuit 222 detects the reflected signal compared with the instances when the detection circuit fails to detect the reflected signal can be used to determine spin rate and/or the rotational orientation of the despun control portion 124 about the central axis 144.

Furthermore, there are various other methods for detection of body spin utilizing the detection element 236 and perturbing element 240 contemplated as within the scope of this disclosure. For example, in some embodiments, the body spin detection device 224 can be configured for impedance matching to determine the spin rate of the despun control portion 124. As such, in various embodiments the detection element 236 and perturbing element 240 can be configured for impedance matching of the detecting circuit 222 based on the rotational orientation of the detection element 236 and perturbing element 240. For example, in various embodiments the detecting circuit 222 can be configured to be impedance matched while the detection element 236 is not aligned with the perturbing element 240 but not be impedance matched when the detection element 236 and perturbing element 240 are aligned.

As described above, in various embodiments, the time difference between the instances when the detection circuit 222 impedance matched or not impedance matched can then be used to determine spin rate and/or the rotational orientation of the despun control portion 124 about the central axis 144.

In some embodiments, the detection element 236 can include one or more additional matching elements or waveguides in the annular shoulder 232 that may be placed with the detection element 236. In various embodiments, these additional waveguides can be electrically connected to the detection element 236 in series, in parallel, or both. In certain embodiments, these electrically connected matching elements are configured to combine and cancel the transmitted electrical signal from the detection element 236 such that little signal is reflected by the first face 228 of the despun control portion 124.

In these embodiments, the perturbing element 240 is configured as a waveguide similar to the detection element 236. As such, in various embodiments, when the perturbing element 240 and the detection element 236 are aligned, the transmitted electrical signal will couple to waveguide perturbing element 240. In various embodiments, in operation, the transmitted electrical signal will then travel down the length of the waveguide perturbing element 240 where the waveguide is terminated in an impedance or load. In various embodiments this load can be designed to reflect most of the signal which then travels back down the perturbing element 240 waveguide and reflects back to the detection element 236. In various embodiments, when received by the detection element 236 the reflected signal then is transmitted to the detection circuitry 222 where it can be measured.

Again, as described above, this reflected signal will be different from any signal at the detection circuitry 222 when the perturbing element 240 is not aligned with the detection element 236. This difference in signal characteristics (in amplitude, phase, etc.) will denote the time at which the perturbing element 240 is located adjacent to the detection element 236 and can be used to determine spin rate and/or the time at which the spinning portion is oriented in a particular manner.

In various embodiments the generated electrical signal has a wave frequency such that the wavelength of the electromagnetic wave is comparable to or smaller than the projectile diameter. For example, in certain embodiments the electrical signal is a microwave having a wavelength in the range 0.001 meters to 0.3 meters. However, in certain embodiments the electromagnetic wave could have a larger or smaller wavelength. For example, in certain embodiments the electrical signal could be a microwave having a wavelength in the range of 1 mm to 1 meter. In certain embodiments the wavelength of the electrical signal can be selected based on the type/size of projectile. For example, the wavelength could be larger for larger projectiles such as artillery shells, large caliber munitions, mortars, or other suitable projectiles.

Figure 4A:
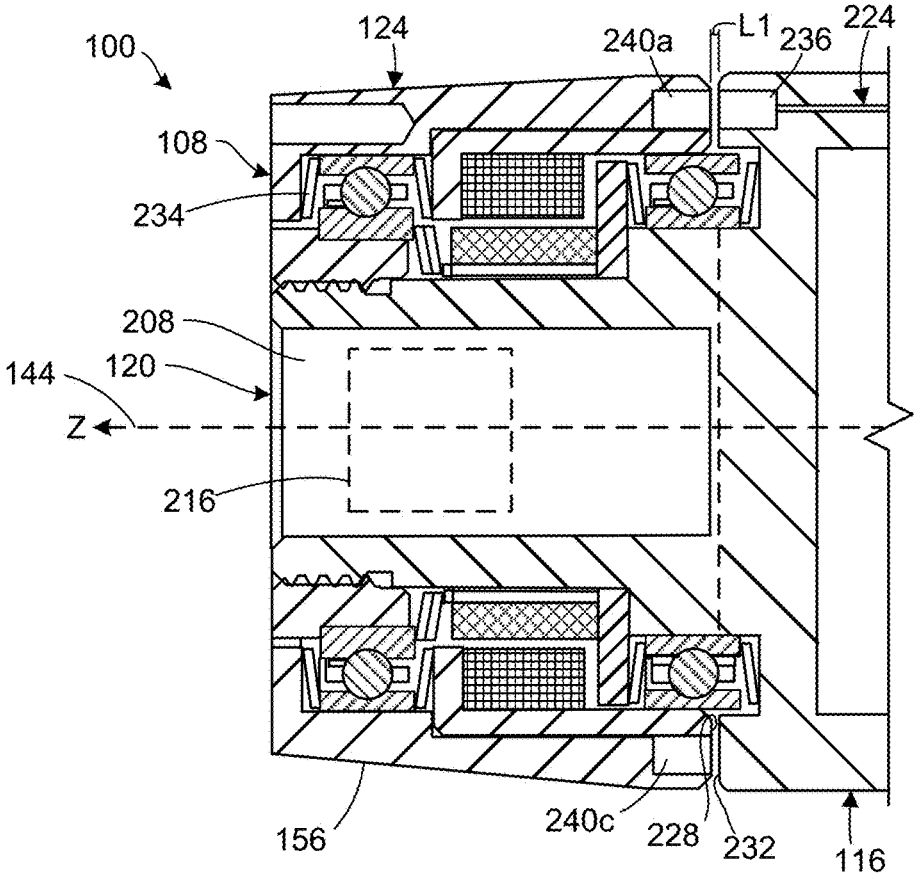
FIGS. 4A-4B depicts a cross-sectional view and a front view of a despun control portion, according to one or more embodiments of the disclosure.
Figure 4B:
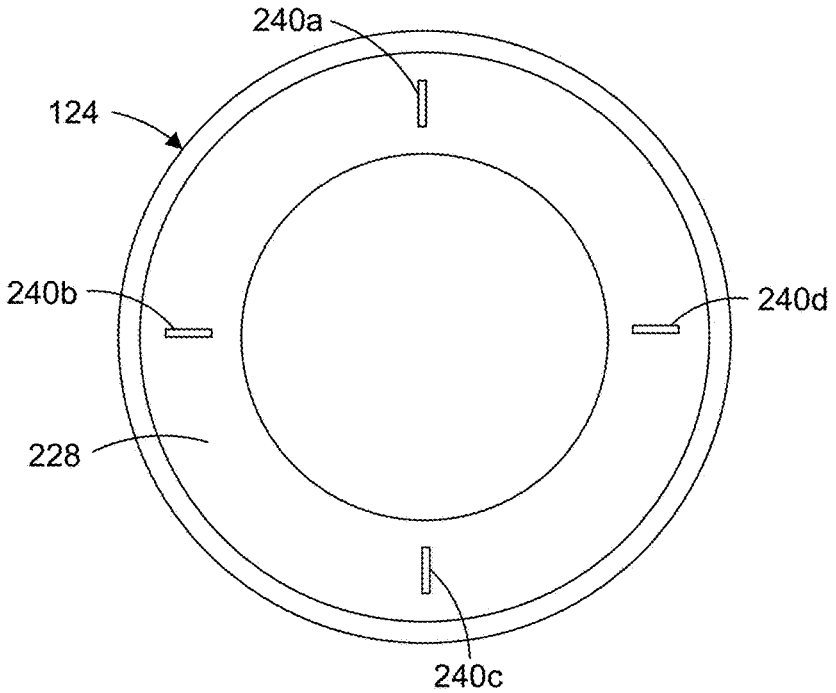

Referring to FIGS. 4A-4B, a cross-sectional view and a front view of a despun control portion 124 are depicted, according to one or more embodiments of the disclosure. Despun control portion 124 is substantially similar to the despun control portion depicted in FIGS. 1-3 and described above. As such, like elements are referred to with like reference numerals.

In one or more embodiments the despun control portion 124 includes a plurality of perturbing elements 204*a*, 204*b*, 204*c*, 204*d*. In certain embodiments perturbing elements 204*a*, 204*b*, 204*c*, 204*d*, are spaced circumferentially about the first face 228 for altering or otherwise changing characteristics of an electric signal transmitted by a detection element 236. As described above, in certain embodiments the characteristics (e.g. amplitude, phase, etc.) of the reflected electrical signal will differ based on whether the signal is reflected by the first face 228 or is reflected by one of the perturbing elements 204*a*, 204*b*, 204*c*, 204*d*.

For example, in various embodiments each of the perturbing elements 204*a*, 204*b*, 204*c*, 204*d* includes various features that modify or alter the characteristics of the reflected electric signal as compared to when the signal is reflected by the first face 228. Further, in certain embodiments each of the perturbing elements modify or alter characteristics of the reflected signal in a manner that is unique to each of the perturbing elements 204*a*, 204*b*, 204*c*, 204*d*. As such, in various embodiments, the reflected electrical signal can act as a reference signal for the detection circuitry 222 where the detection circuitry can measure the characteristics of the reflected signal to determine which of the perturbing elements 204*a*, 204*b*, 204*c*, 204*d* modified or altered the original signal.

As such, in various embodiments the detection circuit 222 can be configured to determine the specific rotational orientation of the despun control portion 124. For example, in certain embodiments, the detection circuitry can detect a unique reflected signal that indicates that a specific perturbing element 204*a*, 204*b*, 204*c*, 204*d* is aligned with the detection element 236.

Figure 5:
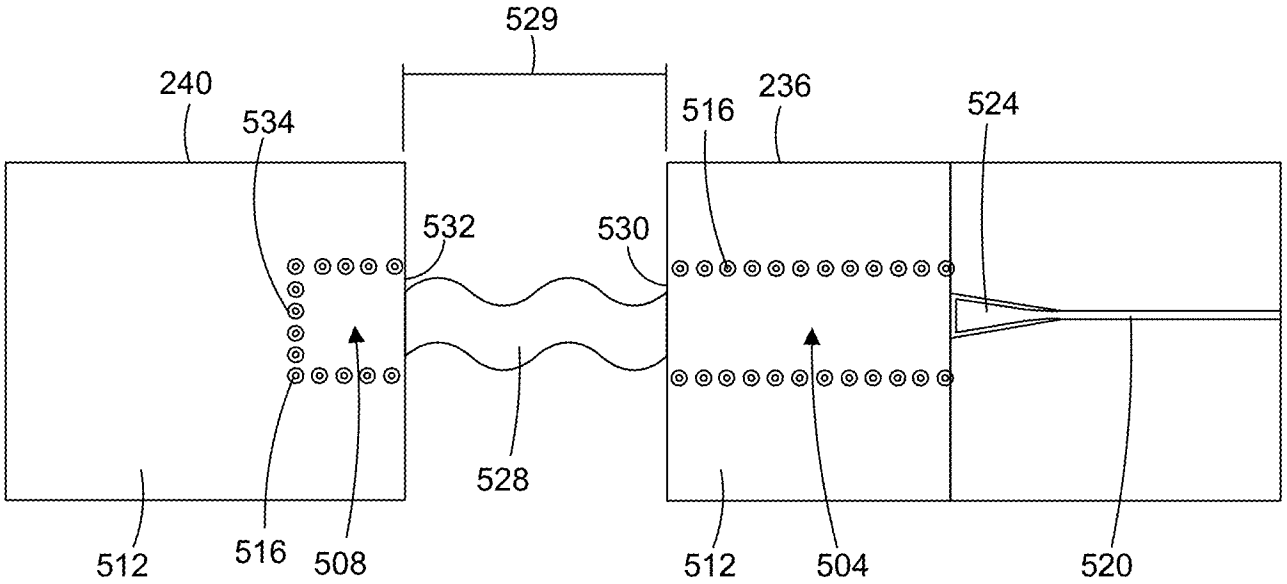
FIG. 5 depicts a detection element and a perturbing element of a body spin detection device, according to one or more embodiments of the disclosure.

Referring to FIG. 5, a design for a detection element 236 and a perturbing element 240 of a body spin detection device 224 are depicted, according to one or more embodiments of the disclosure. In one or more embodiments, and as described above, the detection element 236 and perturbing element 240 can be configured as waveguides for transmitting/leaking an electrical signal between various spinning components of a projectile for determine the relative spin rates of different components.

As such, and depicted in FIG. 5, in certain embodiments the detection element 236 and perturbing element 240 can be configured having surface integrated waveguides (SIW) 504, 508. As such, in certain embodiments, detection element 236 and perturbing element 240 are formed on a printed circuit board substrate 512 having two ground planes that are parallel to each other, and a plurality of metalized vias 516 that define a waveguide portion of the SIW. For example, in the detection element 236, two parallel rows of vias 516 serve as side walls, which along with the two ground planes, confine and guide an electric signal or other electromagnetic wave.

In various embodiments the detection circuit 236 includes a microstrip transmission line 520 and a transition section 524. In various embodiments the transmission line 520 and transition section 524 are configured to be communicatively connected to the SIW 504 to serve as an input/output line for the detection element 236. For example, in various embodiments the microstrip transmission line 520 can be used to transmit/receive electromagnetic waves or electric signals for interfacing with detection circuitry 222 (FIGS. 2-3) of a body spin detection device, as described above.

As described above, in various embodiments the SIW 504 of the detection element 236 is left open circuited at the end which faces the perturbing element 240 for transmission/leaking of an electrical signal or electromagnetic wave between the two elements 236, 240. For example, depicted in FIG. 5, an electric signal 528 is shown being transmitted across a gap 529 to/from an open circuited portion 530 of the detection element 236 to another open circuited portion 532 of the perturbing element 240 that faces the detection element 236. In the embodiment shown, the perturbing element 240 has an SIW 508 that is terminated in a short circuit 534 formed be a row of vias 516 at the end which are perpendicular to the parallel side via rows. However, in various embodiments, as described above, the perturbing element 240 could be communicatively connected to some detection circuitry or a signal source. As such, in certain embodiments the perturbing element 240 has an SIW 508 that terminates with a connection to a microstrip transmission line, similar to SIW 504 and transmission line 520.

In operation, in various embodiments, perturbing element 240 and detection element 236 function substantially similar as described above with reference to FIGS. 2-3. For example, in various embodiments the signal 528 can be transmitted outward from the detection element 236 in the direction of the perturbing element and/or the first face 228 of a despun control portion 124 (FIGS. 2-3). In various embodiments the signal 528 will reflect back towards the detection element 236 but possess various altered signal characteristics that can be used to detect the times at which the perturbing element 240 is aligned with the detection element 236. As such, in various embodiments this information can be used to determine spin rate and/or the rotational orientation of the despun control portion 124 about the central axis 144.

Figure 6:
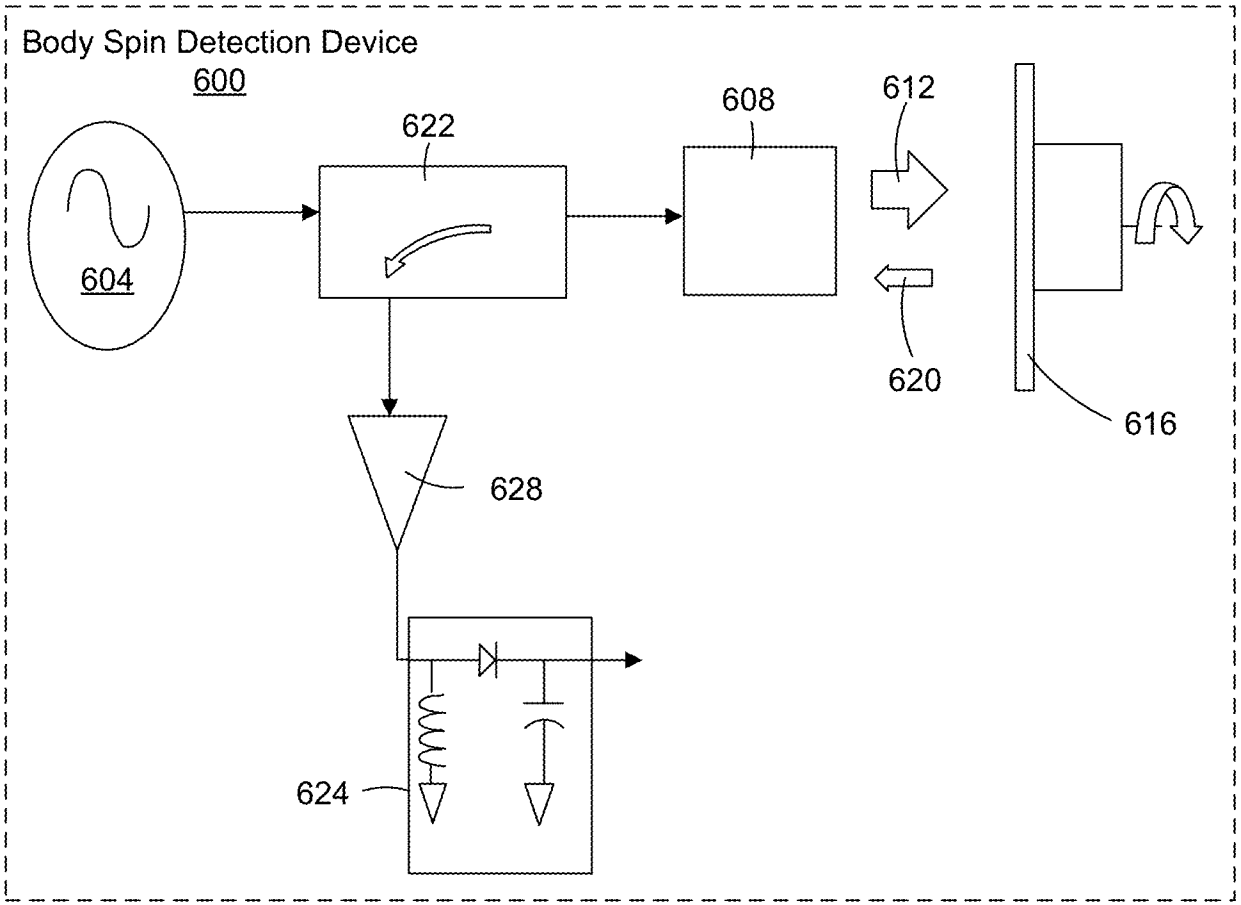
FIG. 6 depicts a high level system view of a body spin detection device 600, according to one or more embodiments of the disclosure.

Referring to FIG. 6, a high level system view of a body spin detection device 600 is depicted, according to one or more embodiments of the disclosure. In various embodiments body spin detection device 600 is substantially similar to device 224, described above with reference to FIGS. 2-4.

In one or more embodiments device 600 is configured as a reflectometer including a signal source 604 comprising a voltage controlled oscillator (VCO) that, in operation, generates a sinewave or other electronic wave. In various embodiments the signal source is coupled with a waveguide 608, such as detection element 236 as described above, or other waveguide for transmitting the signal. In various embodiments, in operation, the transmitted signal 612 is transmitted to a rotating or spinning surface 616 that includes one or more perturbing elements, such as perturbing element 240, or other waveguides. In various embodiments, the surface 616 results in some portion of the transmitted signal 612 being reflected back to the waveguide 608 as a reflected signal 620 where it is sampled by a directional coupler 622 and transmitted towards detection circuitry 624. In certain embodiments, the reflected signal may be amplified by an amplifier 628.

In one or more embodiments the detection circuitry 622 is configured to convert the signal 620 into a low frequency voltage. In various embodiments, as a result of one or more perturbing elements in the surface 612, characteristics of the reflected signal will differ based on whether the originating signal was reflected by a perturbing element or not. As such, in various embodiments the voltage level converted by the detection circuitry 622 can be used to determine when the signal 612 was reflected by one or more perturbing elements in surface 616. As described above, in various embodiments the time between the voltage spikes can be used to determine the spin rate and/or the rotational orientation of the surface 616.

Figure 7:
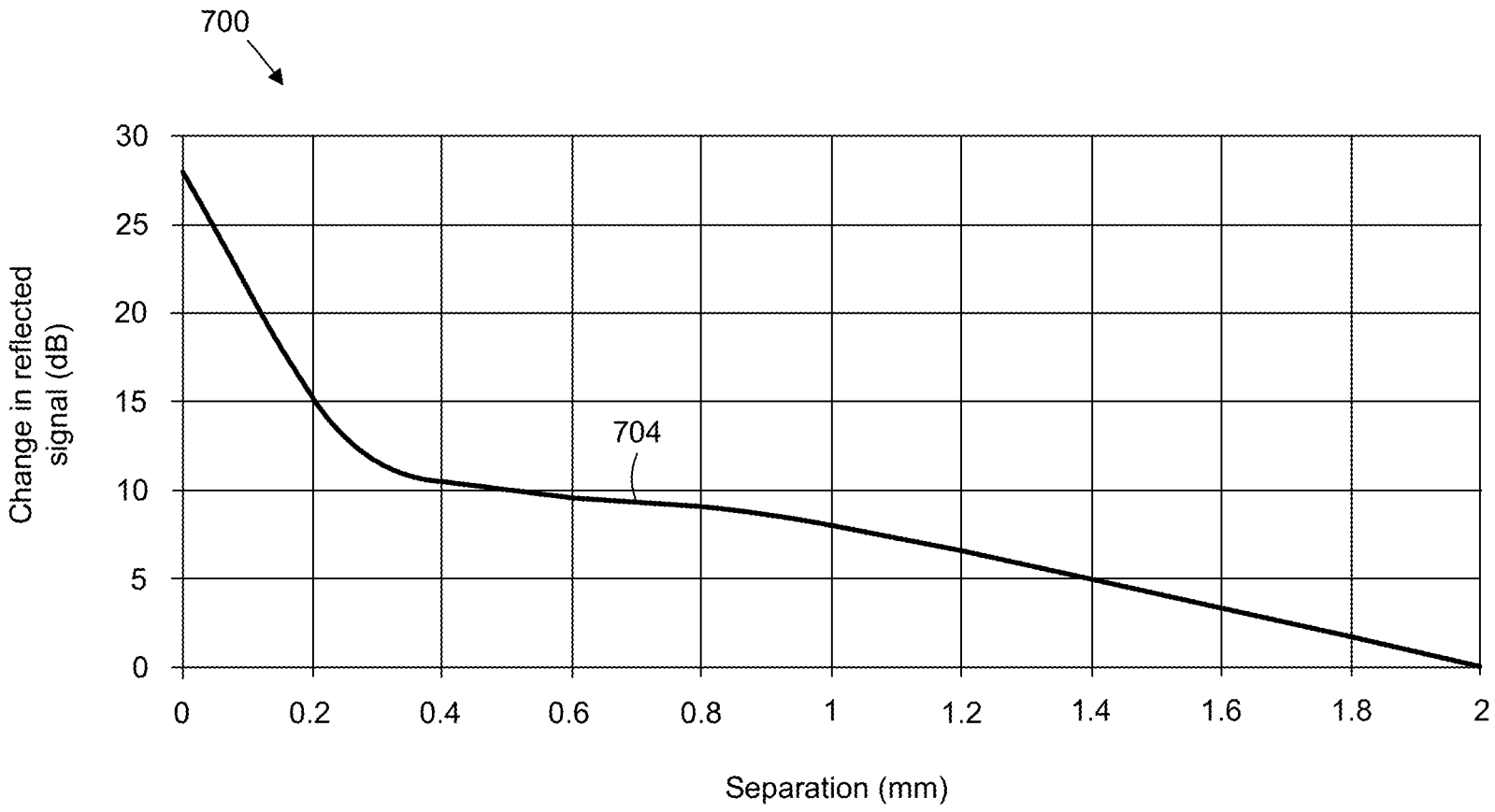
FIG. 7 depicts results of an experiment on the relative strength of a reflected electric signal transmitted from a detection element and detected by detection circuitry of a body spin detection device, according to one or more embodiments of the disclosure.

FIG. 7 depicts results 700 of an experiment on the relative strength (in decibels) of a reflected signal transmitted from a detection element and detected by detection circuitry, according to one or more embodiments. In various embodiments an SMA connector was placed at the end of a microstrip line to simulate a waveguide, such as a detection element. This SMA connector was connected to a vector network analyzer that to measure a reflected electric signal. A block of brass was positioned adjacent to the open end of the SMA connector simulating placing a short circuit at that point that reflects the electric signal. The reflected signal was measured for a range of gaps between the open end and the block. The change in the strength of the reflect signal is plotted on line 704 as compared to gap spacing is given in FIG. 7. As can be seen, gaps having a length of approximately 1 mm or less create a stronger reflected signal for detection by detection circuitry. As such, in various embodiments gap L1 (FIG. 3) and gap 529 can be appropriately sized to maximize the strength of the reflected signal, while still allowing spacing between various components of the projectile 100 for allowing free rotation of the despun control portion 124.

Figure 8:
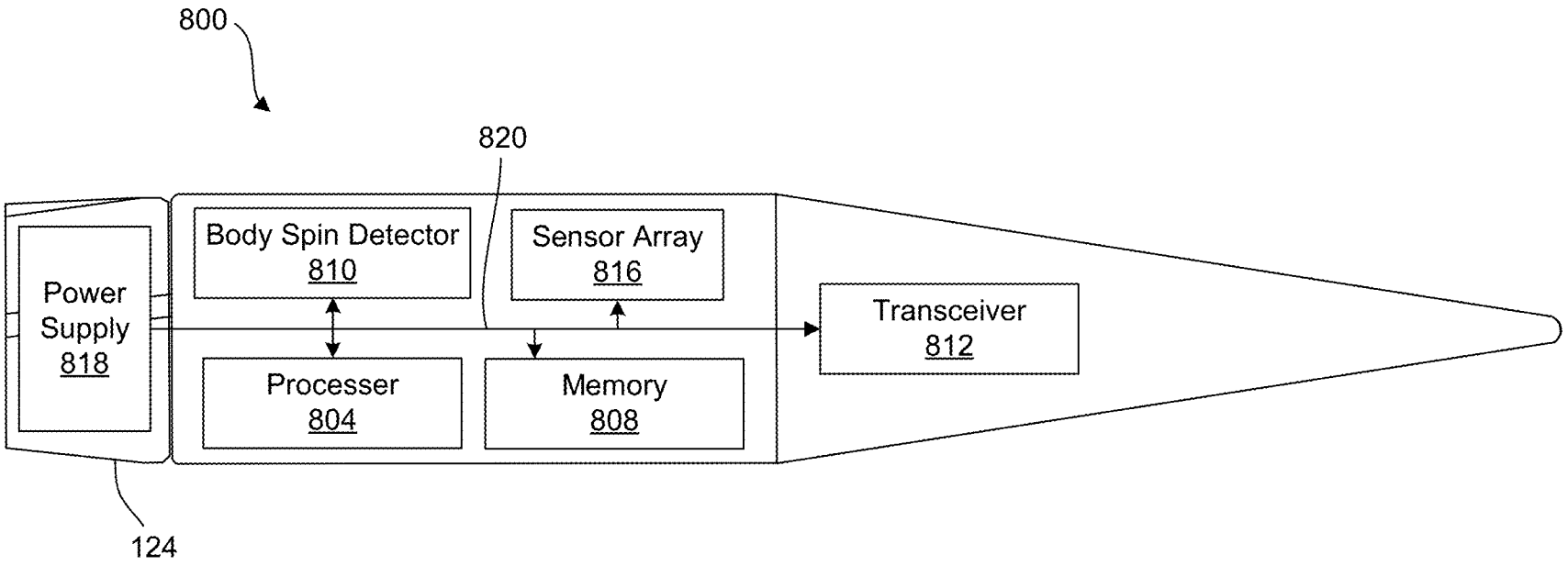
FIG. 8 depicts a system architecture for a guided projectile, according to one or more embodiments of the disclosure.

Referring to FIG. 8, a system architecture for a guided projectile 800 is depicted, according to one or more embodiments. In various embodiments, guided projectile 800 is the same or substantially similar to guided projectile 100 described above and depicted with reference to at least FIGS. 1-4. The guided projectile 800 may include a processor 804, memory 808, body spin detection device 810, a transceiver 812, a sensor array 816, power supply 818, and a bus 820 that couple the various system components. In one or more embodiments, the various components in the guided projectile 800 represent a special purpose computing system for projectile flight control, sensor based target measurements, in-flight spin rate control, and for other functions, according to embodiments disclosed herein.

In one or more embodiments, the guided projectile 800 may include executable instructions, such as program modules, stored in memory 808 (e.g. computer readable storage medium) for execution by the processor 804. Program modules may include routines, programs, objects, instructions, logic, data structures, and so on, that perform particular tasks according to one or more of the embodiments described herein.

In one or more embodiments, the guided projectile 800 includes the sensor array 816 for determining projectile velocity, projectile spin rate, and other data for determining an SG for the projectile 800. In various embodiments, guided projectile 800 includes the power supply 818 in the form of an alternator that is configured to generate power for the projectile 800. For example, in one or more embodiments, when fired, a flight control portion in the form of a despun control portion 124 is aerodynamically despun relative to the remainder of the projectile 800 causing relative rotation between elements of the alternator and thereby generating sufficient power for operation of the processor 804, memory 808, body spin detection device 810, transceiver 812, and sensor array 816. In certain embodiments, power supply 818 may additionally include a battery.

Figure 9:
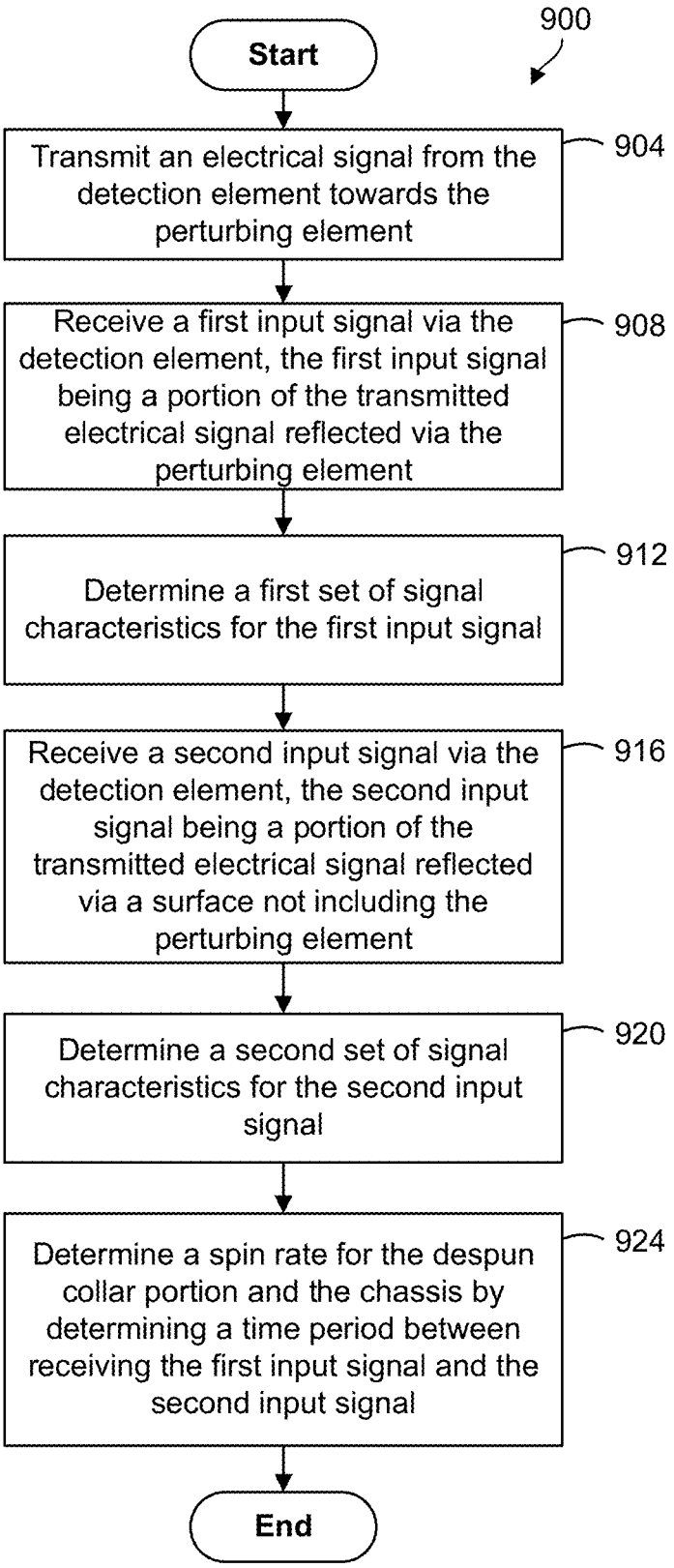
FIG. 9 depicts a method for body spin detection for a rotating chassis and despun collar portion, according to one or more embodiments of the disclosure.

Referring to FIG. 9 a method 900 for body spin detection for a rotating chassis and despun collar portion is depicted, according to one or more embodiments of the disclosure. As described above, in various embodiments a detection element can be mounted in one of the first face and the opposing annular shoulder of a chassis and despun collar portion. Similarly, in various embodiments one or more perturbing elements can be mounted in the other of the first face and the opposing annular shoulder of the chassis and despun collar portion. As such, in various embodiments the one or more perturbing elements and the detection element are positioned opposing one another such that the despun collar portion and chassis have a plurality of rotational orientations, relative to one another about the central axis, including a first rotational orientation where at least one of the plurality of perturbing elements and the detection element are rotationally aligned and a second rotational orientation where the plurality of perturbing elements and the detection element are rotationally non-aligned.

In one or more embodiments the method 900 includes, at operation 904, transmitting, via the detection element, an electrical signal in an axial direction towards the perturbing element and the other of the first face and the opposing annular shoulder.

In one or more embodiments the method 900 includes, at operation 908, receiving, via the detection element, a first input signal. In various embodiments, and as described above, the first input signal is a reflected portion of the transmitted electrical signal reflected via the perturbing element.

In one or more embodiments the method 900 includes, at operation 912, determining a first set of signal characteristics for the first input signal. As described above, in various embodiments, as a result of one or more perturbing elements, characteristics of the reflected signal will differ based on whether the transmitted signal was reflected by a perturbing element or not. For instance, the voltage level converted by the detection circuitry will vary based on whether the transmitted signal was reflected by a perturbing element.

In one or more embodiments the method 900 includes, at operation 916, receiving, via the detection element, a second input signal, the second input signal being a reflected portion of the transmitted electrical signal reflected via the other of the first face and the opposing annular shoulder not including the perturbing element.

In one or more embodiments the method 900 includes, at operation 920, determining a second set of signal characteristics for the second input signal.

In one or more embodiments the method 900 includes, at operation 924, determining, a spin rate for at least one of the despun collar portion and the chassis by determining a time period between receiving the first input signal and the second input signal.

In various embodiments, operation 924 can additionally include determining that the first and second input signals are different. For instance, in such embodiments operation 924 can include comparing the first set of signal characteristics to the second set of signal characteristics to determine instances where the signal is altered by the perturbing element as compared to instances where the input signal is unaffected by the perturbing element. For instance, as described above, in certain embodiments the voltage level converted by the detection circuitry will vary based on whether the transmitted signal was reflected by a perturbing element or not. As such, in various embodiments the first and second input signals can be differentiated by comparing the voltage levels of each signal.

In one or more embodiments, the input signals can be used to determine when the signal was reflected by one or more perturbing elements in surface. As described above, in various embodiments the time between the voltage spikes can be used to determine the spin rate and/or the rotational orientation of the surface. For example, voltage levels corresponding to the first input signal will indicate that the detection element is rotationally aligned with the at least one perturbing element. Similarly, in various embodiments the time differential between voltage spikes can be used to determine the spin rate of the despun collar/chassis. In certain embodiments, the spin rate along with the first input signal can be used to determine the rotational position of the despun collar at any particular moment, by using the spin rate and time since the first input signal was received to determine the rotational orientation of the collar.

Figure 10:
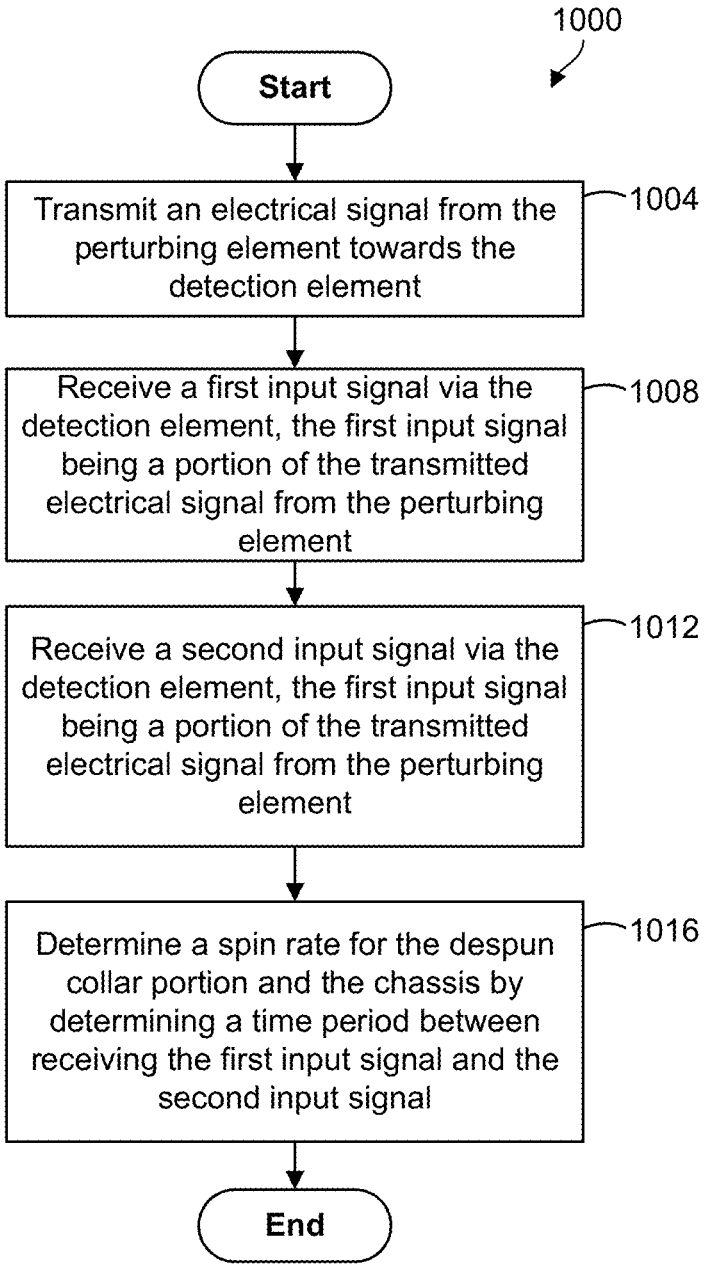
FIG. 10 depicts a method for body spin detection for a rotating chassis and despun collar portion, according to one or more embodiments of the disclosure.

Referring to FIG. 10 a method 1000 for body spin detection for a rotating chassis and despun collar portion is depicted, according to one or more embodiments of the disclosure. As described above, in various embodiments a detection element can be mounted in one of the first face and the opposing annular shoulder of a chassis and despun collar portion. Similarly, in various embodiments one or more perturbing elements can be mounted in the other of the first face and the opposing annular shoulder of the chassis and despun collar portion. As such, in various embodiments the one or more perturbing elements and the detection element are positioned opposing one another such that the despun collar portion and chassis have a plurality of rotational orientations, relative to one another about the central axis, including a first rotational orientation where at least one of the plurality of perturbing elements and the detection element are rotationally aligned and a second rotational orientation where the plurality of perturbing elements and the detection element are rotationally non-aligned.

In one or more embodiments the method 1000 includes, at operation 1004, transmitting an electrical signal from a perturbing element towards a detection element. As described above, while various embodiments herein describe that the detection element is configured to transmit the electrical signal, in some embodiments the perturbing element can be configured to generate a reference signal for detection by the detecting circuit. In such embodiments, the perturbing element is configured as a waveguide such that an electronic reference signal is transmitted outward of the perturbing element from the first face to the annular shoulder of the chassis.

As such, in various embodiments, if the perturbing element and detection element are rotationally aligned, configured in the first state, the detection element will receive the electrical signal directed from the perturbing element. However, if the perturbing element and the detection element are non-aligned, configured in the second state, the reference signal will instead reflect off the annular shoulder and will not be received by the detection element for detection by the detection circuitry.

In such embodiments, where the perturbing element is configured to generate the reference signal, the presence of the reflected electrical signal will indicate that the perturbing element and the detection element are configured in the first state while the lack of a detected reference signal will indicate that the perturbing element and the detection element are configured in the second state.

In one or more embodiments the method 1000 includes, at operation 1008, receiving a first input signal via the detection element and, at operation 1012, receiving a second input signal via the detection element. In one or more embodiments the method 1000 includes, at operation 1016, determining a spin rate for at least one of the despun collar portion and the chassis by determining a time period between receiving the first input signal and the second input signal.

As described above, in various embodiments, the time difference between the instances when the detection circuit detects the reflected signal compared with the instances when the detection circuit fails to detect the reflected signal can be used to determine spin rate and/or the rotational orientation of the despun control portion about the central axis.

One or more embodiments may be a computer program product. The computer program product may include a computer readable storage medium (or media) including computer readable program instructions for causing a processor control an in-flight spin rate of a spin-stabilized projectile, according to the various embodiments described herein.

The computer readable storage medium is a tangible non-transitory device that can retain and store instructions for use by an instruction execution device. The computer readable storage medium may be, for example, an electronic storage device, a magnetic storage device, an optical storage device, or other suitable storage media.

A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Program instructions, as described herein, can be downloaded to respective computing/processing devices from a computer readable storage medium or to an external computer or external storage device via a network, for example, the Internet, a local area network, a wide area network and/or a wireless network. A network adapter card or network interface in each computing/processing device may receive computer readable program instructions from the network and forward the computer readable program instructions for storage in a computer readable storage medium within the respective computing/processing device.

Computer readable program instructions for carrying out one or more embodiments, as described herein, may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages.

The computer readable program instructions may execute entirely on a single computer, or partly on the single computer and partly on a remote computer. In some embodiments, the computer readable program instructions may execute entirely on the remote computer. In the latter scenario, the remote computer may be connected to the single computer through any type of network, including a local area network (LAN) or a wide area network (WAN), or public network.

One or more embodiments are described herein with reference to a flowchart illustrations and/or block diagrams of methods, systems, and computer program products for enhancing target intercept according to one or more of the embodiments described herein. It will be understood that each block of the flowchart illustrations and/or block diagrams, and combinations of blocks in the flowchart illustrations and/or block diagrams, may be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the functions/acts specified in the flowcharts and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some embodiments, the functions noted in the block may occur out of the order noted in the figures. For example, two blocks shown in succession may, in fact, be executed substantially concurrently, or the blocks may sometimes be executed in the reverse order, depending upon the functionality involved.

In addition to the above disclosure, the following U.S. Patent Applications are incorporated by reference herein in their entirety for all purposes: Ser. No. 15/998,269; 15/290,755; 15/290,768; 15/290,844. Furthermore, the following U.S. Patents are incorporated by reference herein in their entirety for all purposes: U.S. Pat. Nos. 3,111,080; 4,537,371; 4,373,688; 4,438,893; 4,512,537; 4,568,039; 5,425,514; 5,452,864; 5,788,178; 6,314,886; 6,422,507; 6,502,786; 6,629,669; 6,981,672; 7,412,930; 7,431,237; 7,781,709; 7,849,800; 8,258,999; 8,319,164; and 9,040,885

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A body spin detection device for a rotating chassis and despun collar portion, the device comprising:

a chassis extending axially from a tail portion to a nose portion, the chassis defining a generally cylindrical wall and further defining a collar support portion extending axially from the tail portion;

a despun collar portion rotationally mounted on the collar support portion, the despun collar portion separated axially from the chassis for free despinning of the despun collar portion relative to the chassis about a central axis, the despun collar portion separated by a gap between a first face of the despun collar portion and an opposing annular shoulder of the chassis;

a detection element mounted in one of the first face and the opposing annular shoulder; and a perturbing element mounted in the other of the first face and the opposing annular shoulder, the perturbing element and the detection element positioned opposing one another such that the despun collar portion and chassis having a plurality of rotational orientations, relative to one another about the central axis, including a first rotational orientation where the perturbing element and the detection element are rotationally aligned and a second rotational orientation where the perturbing element and the detection element are rotationally non-aligned; and detection circuitry electrically coupled with the detection element, the detection circuitry including a processor and a computer readable storage medium, the computer readable storage medium including a set of instructions executable by the processor to cause the detection circuitry to:

transmit, via the detection element, an electrical signal in an axial direction towards the perturbing element and the other of the first face and the opposing annular shoulder;

receive, via the detection element, a first input signal, the first input signal being a reflected portion of the transmitted electrical signal reflected via the perturbing element;

determine a first set of signal characteristics for the first input signal;

receive, via the detection element, a second input signal, the second input signal being a reflected portion of the transmitted electrical signal reflected via the other of the first face and the opposing annular shoulder not including the perturbing element;

determine a second set of signal characteristics for the second input signal; and determine, by comparing the first set of signal characteristics to the second set of signal characteristics, that the first input signal is different from the second input signal.

2. The device of claim 1, wherein the other of the of the first face and the opposing annular shoulder includes a plurality of perturbing elements spaced circumferentially from one another about the central axis, wherein the first input signal is reflected via at least one of the plurality of perturbing elements.

3. The device of claim 1, wherein the detection element is a surface integrated waveguide configured to transmit electromagnetic waves towards the perturbing element and the other of the first face and the opposing annular shoulder.

4. The device of claim 1, wherein the electrical signal is a microwave having a wavelength in the range 1 millimeter to 30 centimeters.

5. The device of claim 1, wherein the electrical signal is a microwave having a wavelength in the range of 1 millimeter to 1 meter.

6. The device of claim 1, wherein no portion of the detection element or the perturbing element extends outwardly beyond a radial envelope of the projectile.

7. The device of claim 1, wherein the detecting circuitry is impedance matched with the detecting element.

8. A body spin detection device for a chassis and despun collar portion, the device comprising:

a chassis extending axially from a tail portion to a nose portion, the chassis defining a generally cylindrical wall and further defining a collar support portion extending axially from the tail portion;

a despun collar portion rotationally mounted on the collar support portion, the despun collar portion separated axially from the chassis for free despinning of the despun collar portion relative to the chassis about a central axis, the despun collar portion separated by a gap between a first face of the despun collar portion and an opposing annular shoulder of the chassis;

a detection element mounted in one of the first face and the opposing annular shoulder;

a plurality of perturbing elements mounted in the other of the first face and the opposing annular shoulder and spaced circumferentially from one another about the central axis, the plurality of perturbing elements and the detection element positioned opposing one another such that the despun collar portion and chassis having a plurality of rotational orientations, relative to one another about the central axis, including a first rotational orientation where at least one of the plurality of perturbing elements and the detection element are rotationally aligned and a second rotational orientation where the plurality of perturbing elements and the detection element are rotationally non-aligned; and detection circuitry electrically coupled with the detection element, the detection circuitry including a processor and a computer readable storage medium, the computer readable storage medium including a set of instructions executable by the processor to cause the detection circuitry to:

transmit, via at least one of the plurality of perturbing elements, an electrical signal in an axial direction towards the detection element and the one of the first face and the opposing annular shoulder;

receive, via the detection element, a first input signal from the transmitted electrical signal;

receive, via the detection element, a second input signal from the transmitted electrical signal;

determine a spin rate for at least one of the despun collar portion and the chassis by determining a time period between receiving the first input signal and the second input signal.

9. The device of claim 8, wherein the other of the of the first face and the opposing annular shoulder includes a plurality of perturbing elements spaced circumferentially from one another, wherein the first input signal is transmitted by at least one of the plurality of perturbing elements.

10. The device of claim 9, wherein each of the plurality of perturbing elements are configured to transmit a different electrical signal towards the detection element and the one of the first face and the opposing annular shoulder.

11. The device of claim 10, wherein the perturbing element is a surface integrated waveguide configured to transmit electromagnetic waves towards the detection element.

12. The device of claim 8, wherein the electrical signal is a microwave having a wavelength in the range 1 millimeter to 30 centimeters.

13. The device of claim 8, wherein the electrical signal is a microwave having a wavelength in the range of 1 millimeter to 1 meter.

14. The device of claim 8, wherein no portion of the detection element or the perturbing element extends outwardly beyond a radial envelope of the projectile.

15. The device of claim 8, wherein the detecting circuitry is impedance matched with the detecting element.

16. A computer-program product for detecting body spin of a chassis and despun collar portion, the chassis extending axially from a tail portion to a nose portion, the chassis defining a generally cylindrical wall and further defining a collar support portion extending axially from the tail portion, the despun collar portion rotationally mounted on the collar support portion, the despun collar portion separated axially from the chassis for free despinning of the despun collar portion relative to the chassis about a central axis, the despun collar portion separated by a gap between a first face of the despun collar portion and an opposing annular shoulder of the chassis, the computer-program product encoded on a computer readable data storage medium, wherein the computer readable data storage medium is not a transitory signal per se, the computer-program product comprising elements that, when processed in a computer, executes a method comprising:

transmitting an electrical signal from a detection element in an axial direction towards a perturbing element, the detection element mounted in one of the first face and the opposing annular shoulder, the perturbing element mounted in the other of the first face and the opposing annular shoulder, the perturbing element and the detection element positioned opposing one another such that the despun collar portion and chassis have a plurality of rotational orientations, relative to one another about the central axis, including a first rotational orientation where the perturbing element and the detection element are rotationally aligned and a second rotational orientation where the perturbing element and the detection element are rotationally non-aligned; and receiving, via the detection element, a first input signal, the first input signal being a reflected portion of the transmitted electrical signal that is reflected via the perturbing element;

determining a first set of signal characteristics for the first input signal;

receiving, via the detection element, a second input signal, the second input signal being a reflected portion of the transmitted electrical signal that is reflected via the other of the first face and the annular shoulder not including the perturbing element;

determining a second set of signal characteristics for the second input signal;

determining, by comparing the first set of signal characteristics to the second set of signal characteristics, that the first input signal is different from the second input signal; and determining a spin rate for at least one of the despun collar portion and the chassis by determining a time period between receiving the first input signal and the second input signal.

17. The computer-program product of claim 16, wherein the other of the of the first face and the opposing annular shoulder includes a plurality of perturbing elements spaced circumferentially from one another about the central axis, wherein the first input signal is reflected via at least one of the plurality of perturbing elements.

18. The computer-program product of claim 16, wherein the detection element is a surface integrated waveguide configured to transmit electromagnetic waves towards the perturbing element and the other of the first face and the opposing annular shoulder.

19. The computer-program product of claim 16, wherein the electrical signal is a microwave having a wavelength in the range 1 millimeter to 30 centimeters.

20. The computer-program product of claim 16, wherein the electrical signal is a microwave having a wavelength in the range of 1 millimeter to 1 meter.

* * * * *